US006142316A

United States Patent [19]

Harbour et al.

[11] Patent Number: 6,142,316

[45] Date of Patent: Nov. 7, 2000

[54] PRODUCT MERCHANDISING DISPLAY UNIT WITH REPLACEABLE PRODUCT GRAPHICS

[75] Inventors: Keith Harbour, Springfield, Ill.; Christopher C. Bidwell, Dunwoody, Ga.; Donald J. Miller, Jr., Belleville, Ill.; Dewalt W. Fowler, Manchester; William B. McWilliams, Columbia, both of Mo.

[73] Assignee: Paul Flum Ideas, Inc., St. Louis, Mo.

[21] Appl. No.: 09/053,572

[22] Filed: Apr. 1, 1998

Related U.S. Application Data

[60] Provisional application No. 60/061,348, Oct. 8, 1997.

[51] Int. Cl.[7] ..... A47F 1/12; A47B 73/00

[52] U.S. Cl. ..... 211/59.2; 211/74; 312/71

[58] Field of Search ..... 211/59.2, 74, 175, 211/184; 312/71

[56] References Cited

U.S. PATENT DOCUMENTS

| | | | |
|---|---|---|---|
| D. 372,381 | 8/1996 | Goldring et al. | D6/476 |
| 2,218,444 | 10/1940 | Vineyard | 211/59.2 |
| 2,572,090 | 10/1951 | Allen | 211/49.1 |
| 4,191,296 | 3/1980 | Morgan | 211/59.2 |
| 4,331,237 | 5/1982 | Edell | 206/461 |
| 4,685,574 | 8/1987 | Young et al. | 211/59.2 |
| 4,785,943 | 11/1988 | Deffner et al. | 211/59.2 |
| 4,785,945 | 11/1988 | Rowse et al. | 211/59.2 |
| 4,923,070 | 5/1990 | Jackle et al. | 211/59.2 |
| 4,953,719 | 9/1990 | Spamer | 211/188 |
| 5,024,336 | 6/1991 | Spamer | 211/59.2 |
| 5,050,748 | 9/1991 | Taub | 211/59.2 |
| 5,351,838 | 10/1994 | Flum | 211/59.2 |
| 5,417,333 | 5/1995 | Flum | 211/59.2 |
| 5,450,968 | 9/1995 | Bustos | 211/59.2 |
| 5,531,336 | 7/1996 | Parham et al. | 211/59.2 X |
| 5,624,042 | 4/1997 | Flum et al. | 211/59.2 |
| 5,634,564 | 6/1997 | Spamer et al. | 211/59.3 |
| 5,645,176 | 7/1997 | Jay | 211/59.2 |

OTHER PUBLICATIONS

Paul Flum Ideas, Inc. advertisng brochure for ULTRA–GLIDE®—1994.

Paul Flum Ideas, Inc. advertisng brochure for COOL GLIDE®—1993.

Paul Flum Ideas, Inc. advertisng brochure for DOUBLER®—1994.

*Primary Examiner*—Daniel P. Stodola
*Assistant Examiner*—Erica B. Harris
*Attorney, Agent, or Firm*—Blackwell Sanders Peper Martin

[57] ABSTRACT

A product module adaptable for interlocking engagement with other similarly constructed modules to form a composite display assembly for merchandising products therefrom, each product module including at least one elongated product channel defined by a pair of laterally spaced upstanding side walls and a substantially planar product supporting floor portion extending therebetween, each product channel including a product graphic panel which is removably attachable to the front portion of each product channel via a wide variety of different constructional arrangements. Each product graphic panel is preferably dimensioned such that when it is attached to the front portion of a particular product channel, the graphic panel will substantially overlay the product identification and graphics associated with the lead product container positioned within that particular product channel. The present product modules may also optionally include an adjustable mechanism for adjusting the fore and aft position of such module relative to the front portion of an underlying support structure upon which the modules may rest. Still other optional features associated with the present product modules function to more effectively facilitate their utilization in a wide variety of different merchandising applications.

57 Claims, 16 Drawing Sheets

PRODUCT MERCHANDISING DISPLAY UNIT WITH REPLACEABLE PRODUCT GRAPHICS

This application claims the benefit of U.S. Provisional Application Ser. No. 60/061,348, filed Oct. 8, 1997.

The present invention relates generally to product display devices for use in storing and merchandising shelved products therefrom and, more particularly, to various embodiments of a product merchandising display unit which comprises a plurality of product modules which can be assembled in a columnar array to achieve any desired width and any desired number of product channels depending upon the particular merchandising application, each product channel having a removably attachable product graphic panel associated with the front portion thereof. The present assemblies can be conveniently supported in either a flat horizontal position or in an inclined position for gravity feeding products positioned thereon, and may include an adjustable mechanism for properly positioning the present assemblies relative to the front portion of the underlying support structure upon which they typically rest, depending upon the particular merchandising application. Although the subject devices are primarily designed for use in a wide variety of refrigerated display cases presently utilized in supermarkets, convenience stores, and other food and beverage outlets, they are likewise adaptable for use in many other display shelf applications.

BACKGROUND OF THE INVENTION

It is common practice to provide product display devices to organize and merchandise shelved products to consumers. This is particularly true with respect to displaying and merchandising chilled soft drink products in conventional refrigerated display coolers. See, for example, the display units disclosed in U.S. Pat. Nos. 5,024,336; 5,351,838; 5,417,333; and 5,531,336. It is also common practice to provide product display devices which include a plurality of product channels or modules which can be laterally interlocked together in side-by-side relationship to form an overall stabilized assembly for supporting products in an columnar array. See, for example, the display units disclosed in U.S. Pat. Nos. 4,685,574; 4,785,945; 5,050,748; 5,624,042; 5,634,564; and 5,645,176. This width adjustability has made such product display devices more accommodating for use with known refrigerated coolers having different spatial dimensions.

Since the advent of the larger product containers such as the 20 oz. and 1 liter product containers commonly utilized in the soft drink beverage industry, a wide variety of display devices have been designed and manufactured for use in merchandising these taller product containers. One problem encountered in merchandising these taller product containers is the fact that such taller containers have a greater tendency to tip over either the front wall or the side walls associated with a particular product channel. In order to overcome this toppling tendency, many product display devices now include higher channel divider walls, higher front walls, and a wide variety of different front wall configurations which include higher transversely extending front members or upright posts as well as a wide variety of different front wall stop or abutment members which are positioned and located so as to engage the taller product containers at or above the center of inertia of the lead product container positioned in any product channel. See, for example, the display units disclosed in U.S. Pat. Nos. 4,785,943; 5,351,838; 5,531,336; 5,624,042; and 5,645,176.

Although product display devices have, for the most part, been designed so as to more attractively arrange and position the various shelved products positioned thereon for easy accessibility and visibility by a consumer at the front portion of the unit, greater emphasis is now being placed on product visibility and product graphics. See, for example, U.S. Pat. No. 5,645,176. Because more and more product merchandising units are now displaying a full view of the lead article or product container positioned within any particular product channel, properly orienting the product label or graphics associated with a particular product container, such as a typical soft drink beverage container, has become more important for attractively displaying such products to consumers. For a wide variety of reasons including loading and/or stocking techniques, consumers manipulating the product containers within the various product channels, and the inattentiveness and inability of store personnel to properly orient each individual product container within a multitude of individual product channels merchandising soft drink beverages to consumers in any particular store application, all of these factors contribute to the fact that often times, the lead article or product container in a multitude of product channels is not properly oriented such that the product label or graphics identifying such product is not clearly readable or visible to a consumer positioned in front of the respective product channel. This situation not only presents an unattractive and disorderly arrangement and display of the products in any particular product channel, but such arrangement also detracts from the sale of that particular product since its product identification is not readily accessible and visible to the consumer. The same is likewise true for all of the product containers positioned behind the lead article in any particular product channel. There is no guarantee how each successive product container in any particular product channel will be positioned and oriented at the front portion of the display unit when such product container ultimately assumes the lead article position. One solution to this particular problem is to have store personnel properly orient each product container in all of the numerous product channels utilized in any particular store application so as to ensure that, at least, the lead article in each product channel is properly oriented and facing forward for easy visibility by passing consumers. This solution would require an enormous amount of time for store personnel to achieve, particularly, if all of the product containers in each product channel were properly positioned and oriented, and such solution would require constant monitoring and re-organization throughout the entire operating hours of the particular facility involved.

The above-discussed problem has lessened the attractiveness of the individual product displays, it has required more frequent sorting and re-organizing of the products in the respective product channels, which procedure is extremely time-consuming; and this problem has also been found to impede the sales of those products which are not properly oriented at the front of each product channel. It is therefore a principal aim of the present invention to obviate this particular problem and provide a mechanism for properly orienting the product graphics associated with all of the product containers positioned in any product channel regardless of the respective product container orientations in any such product channel. It is also a principal aim of the present invention to improve upon the prior art display devices referenced above thereby obviating many of the disadvantages and shortcomings associated with such prior art devices and to provide a modular display system which will accommodate product containers of various sizes, which is width adjustable and compatible for use with all of the known refrigerated display coolers, and which includes means for not only interlocking any plurality of product modules so as to provide a unitary, stabilized structure, but which also includes means for adjustably positioning each product module relative to the front portion of the underlying support structure upon which the modules rest for better product visibility and accessibility to consumers.

SUMMARY OF THE INVENTION

The present product merchandising assemblies have overcome many of the disadvantages and shortcomings associated with known product display devices, and each teaches the construction and operation of an adjustable display assembly which is adaptable for use on and with existing shelving equipment, either on a flat shelf surface or on an inclined support structure for gravity feeding products therefrom. The present display assemblies can be used for both chilled and unchilled products and are particularly well suited in merchandising and displaying a wide variety of products therefrom such as soft drink beverages, fruit juices, dairy products and the like in supermarkets, convenience stores, grocery outlets, fast food outlets, and a wide variety of other wholesale and retail stores, as well as use in a wide variety of other product merchandising and storage applications.

Each of the several embodiments of the present invention disclosed herein comprise one or more product modules which can be laterally interlocked together in side-by-side relationship to form an overall stabilized assembly for supporting products positioned thereon in a columnar array. Each product module includes at least one product support channel for guiding products positioned therein, it being contemplated that the respective product channels may vary in lateral width not only to accommodate articles of different dimensions, but also due to the fact that such product modules may include more product channels as compared to others. This will be particularly true in certain merchandising applications. Each product module includes cooperatively engageable interlocking means associated with the respective side edge portions thereof such as the connection means disclosed in U.S. Pat. No. 5,624,042, which patent is assigned to the present assignee, Paul Flum Ideas, Inc. of St. Louis, Mo. The construction of the various product modules enables any number of the present modules to be connected together in any preferred number to form a particular merchandising unit which not only conveniently fits in the allocated space, but also includes the maximum number of product channels for the particular type of product containers to be merchandised therefrom. This is true whether the lateral width of each such product channel is the same or are of varying widths.

Importantly, in the preferred embodiments of the present invention, each product channel includes a detachable/reattachable product graphic insert panel which is removably attachable to the front portion of each product channel by a wide variety of different constructional arrangements as disclosed herein, both the product graphic insert panel and the front portion of each product channel including cooperatively engageable means for securely holding the product insert panel adjacent the front portion of each product channel at a desired location. In this regard, each product graphic insert panel is preferably dimensioned such that when it is attached to the front portion of a particular product channel, the graphic insert panel will substantially overlay the product identification and graphics associated with the particular product container positioned within that particular product channel. In addition, it is contemplated that each product graphic insert panel will be stencilled or otherwise imprinted with the same product graphics and identification associated with the particular product containers being merchandised from that particular product channel such that when the lead product container is positioned at the front of the product channel, the present product insert panel will substantially mate with the graphics portion of the product container. In the case of soft drink beverage products, the present product insert panel will be arcuate in shape so as to correspond to the particular curvature of the product containers positioned within the particular product channel. The specific constructional features for accomplishing this task are set forth below in the detailed description of the preferred embodiments of the present invention.

Since the present product graphic insert panel substantially overlays the graphic portion associated with any particular product container positioned within a particular product channel, use of the insert panel obviates the need for properly orienting the individual product containers within any product channel as the graphics associated with the present insert panel will always be properly oriented relative to a consumer standing in front of the particular product channel. Orientation of the product identification on the individual product containers is therefore rendered unnecessary as the actual product graphics and identification associated with the respective product containers will not be viewed by the consumer. Instead, the consumer will always view the present product graphic insert panel having the appropriate product identification associated therewith. In this regard, since the present product graphic insert panel is removably attachable to the front portion of each product channel, and since different product brands are merchandised from a particular product channel, the present product insert panel can be removed and replaced with the proper product identification compatible with the product brand being merchandised from that particular product channel at that particular time. Although it is preferred that the present product insert panel be removably attachable to the front portion of each product channel, it is also recognized and anticipated that the present product insert panel can be integrally formed with the front portion of the product channel, in which case the product graphics can be removably attachable to the present insert panel such as by using stick-on labels or other types of removably attachable product decals, or by using other means associated with either the front or back surface of the product panel for cooperatively receiving removably replaceable product graphics. It is also contemplated that the size and shape of the present product graphic insert panel as well as its overall configuration can be varied so as to be compatible with the size and shape of the particular product containers being merchandised from any particular product channel. This configuration can include the arcuate configuration disclosed herein as well as a relatively flat planar configuration and still other configurations depending upon the size and shape of the product containers merchandised therefrom.

The present invention encompasses use of the present modules with an underlying support structure since the existing refrigerated cooler equipment all utilize some type of shelf support structure. In this regard, each product module may likewise optionally include means for adjusting the fore and aft position of such module relative to the front portion of the underlying support structure upon which the present modules may rest. More particularly, the present adjustable mechanism includes a plurality of recesses, cavities or channels extending transversely across at least a portion of the width of at least some of the product channels associated with any particular product module adjacent the underside portion thereof, each recess, cavity or channel being adaptable for cooperatively receiving one end portion of a stop member which can be adjustably positioned within any one of the plurality of cavities or channels depending upon the desired position of the product module relative to the front portion of the underlying support structure. The plurality of transversely extending recesses or channels are positioned adjacent the front portion of the selected product channels at a predetermined distance therefrom based upon the overall length of the separate stop member which is cooperatively engageable therewith. The opposite end portion of the stop member includes an abutment surface which will be located a predetermined distance aft of the forwardmost portion of the selected product channels depending upon which particular recess or channel is selected for engagement with the other end portion of the stop member, the abutment surface being designed to rest behind and engage the rear portion of the forwardmost rod member or laterally extending front wall member associated with the underlying support structure thereby preventing the present product modules from moving any further forward relative to the underlying support structure. The relative position of the stop member abutment surface can be varied fore and aft depending upon which recess or channel is selected for engagement with the opposite end of the stop member. This mechanism is particularly advantageous as the present modules can be adjustably positioned fore and aft on any particular underlying support structure so as to position the front portion of each product module at any predetermined distance relative to the cooler doors associated with the known refrigerated display coolers depending upon the particular spacing desired. This mechanism also provides more space up front below the forward portion of each product channel having such mechanism as compared to other known mechanisms and it does not interfere with removal of product containers located therebelow. Means for securely holding the present stop member within any one of the plurality of transversely extending recesses, cavities or channels is likewise disclosed hereinafter.

Other optional features associated with the present product modules include removably replaceable product identification means associated with the rear wall portion of each product channel to further facilitate the placement of the proper products within the respective product channels by store personnel during the loading or restocking process. Since the present product graphic insert panel associated with the front portion of each product channel will identify a specific product brand for that particular product channel, it is imperative that all of the product containers positioned within a particular product channel be of the type identified on the product insert panel. Since many of the existing refrigerated coolers which accommodate the present product modules for merchandising a wide variety of chilled products to consumers, particularly, soft drink beverage products, are loaded from the rear of such coolers, the present rear product channel identification means further facilitates the proper loading and restocking of each product channel.

Another optional feature associated with the present product modules includes means for adjusting the depth of each such product module to further facilitate accommodating such modules on existing support structures having varying depth. This adjustment means includes the use of frangible portions which extend adjacent the rear portion thereof, which frangible rear portions are easily broken off along weakened fracture lines formed in the product modules during the manufacture thereof. Still other optional features include the use of higher guide wall means or flexible/resilient guide wall means capable of providing lateral support for taller product containers positioned in the respective product channels while at the same time providing smooth, free and unrestricted movement of such products within such product channels without binding, squeezing or otherwise hindering the product flow, particularly, in a gravity-free situation.

Because of these capabilities, the present product modules provide simple and efficient means for not only effectively utilizing and maximizing available shelf space but use of the present product graphic insert panel always presents the product identification and graphics associated with the particular product containers being merchandised in any particular product channel up front and centered within each product channel for clear, easy viewing by consumers regardless of the individual orientation of each of the product containers located within the product channel. This is particularly true when the present modules are utilized for merchandising a wide variety of soft drink products. Also, importantly, use of the present product modules provide means for adjusting the overall width and/or depth of the subject units to accommodate varying sizes and different types of underlying support structures; they provide effective means for adjusting the fore and aft position of each product module relative to the front portion of the underlying support structure; and they provide an efficient and extremely stable modular assembly which maximizes adjacent positioning of a plurality of such units within any defined space thereby enabling a user to organize and configure any particular shelf display to meet his/her specific needs and space requirements.

It is therefore a principal object of the present invention to provide an improved modular product merchandising assembly which more effectively displays the various product containers positioned therewithin for sale to consumers.

Another object is to provide a product merchandising assembly which more effectively utilizes available merchandising areas associated with refrigerated display coolers.

Another object is to provide a modular product merchandising assembly which is universally adaptable for use with a wide variety of known product merchandising display equipment.

Another object is to provide a product merchandising assembly which includes removable product graphics associated with each product channel.

Another object is to teach the construction and use of several different types of product modules each including a product graphic insert panel strategically positioned for cooperative engagement with the front portion of each product module.

Another object is to provide a product module having a product graphic insert panel strategically positioned so as to substantially overlay the product identification and graphics associated with the particular product container positioned therebehind in a particular product channel.

Another object is to provide product modules which include means for adjusting their fore and aft position relative to the forward portion of an underlying support structure when the present product modules are positioned thereon.

Another object is to provide a product merchandising assembly wherein the product identification and graphics associated with the lead product in each product channel is always presented upfront, centered, and in proper orientation to a consumer positioned in front of the overall assembly.

Another object is to provide a modular product merchandising assembly which is adaptable for use both on and with existing shelving equipment, either on a flat shelf or on an inclined support structure for gravity feeding products therefrom.

Another object is to provide product modules wherein the rear portion of each product channel associated therewith includes removably replaceable product identification means.

These and other objects and advantages of the present invention will become apparent to those skilled in the art after considering the following detailed specification which discloses several representative embodiments of the present modular product merchandising assembly in conjunction with the accompanying drawings wherein:

DETAILED DESCRIPTION OF THE PREFERRED EMBODIMENTS OF THE INVENTION

Figure 1:
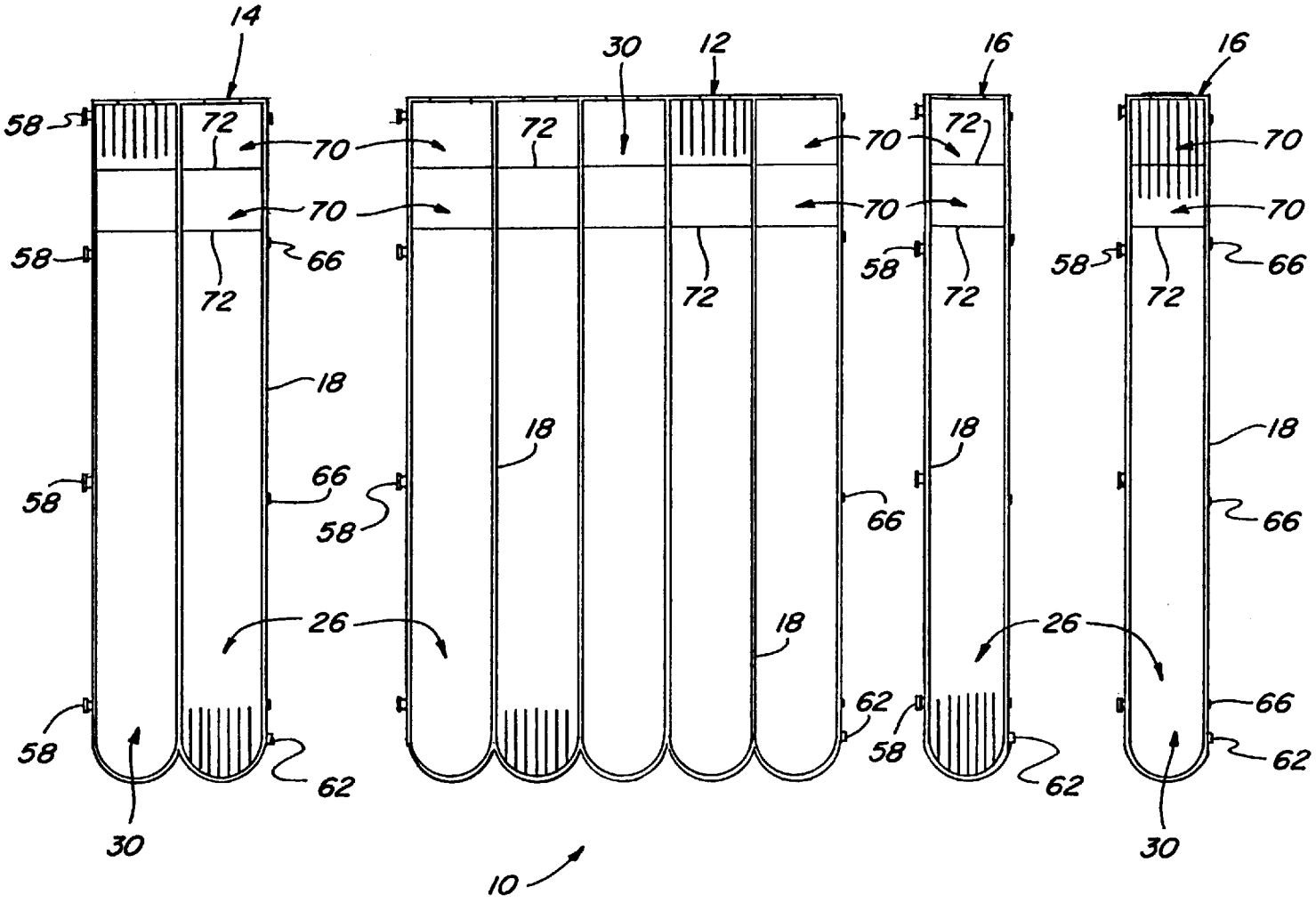
FIG. 1 is a top plan view of a plurality of product modules constructed according to the teachings of the present invention.

Referring to the drawings more particularly by reference numbers wherein like numerals refer to like parts, number 10 in FIG. 1 identifies one particular plurality of product modules constructed according to the teachings of the present invention, this particular plurality of product modules including a product module 12 having five product channels associated therewith, a product module 14 having two product channels associated therewith, and two separate product modules 16 each having a single product channel associated therewith. Since each product module 12, 14 and 16 is substantially similar in construction except for the number of product support channels associated therewith, and since the product graphic insert panel 32 associated with each product channel of each product module is identical in construction, discussion of the present invention will be directly primarily to product module 16 as shown in FIGS. 2–10.

Figure 2:
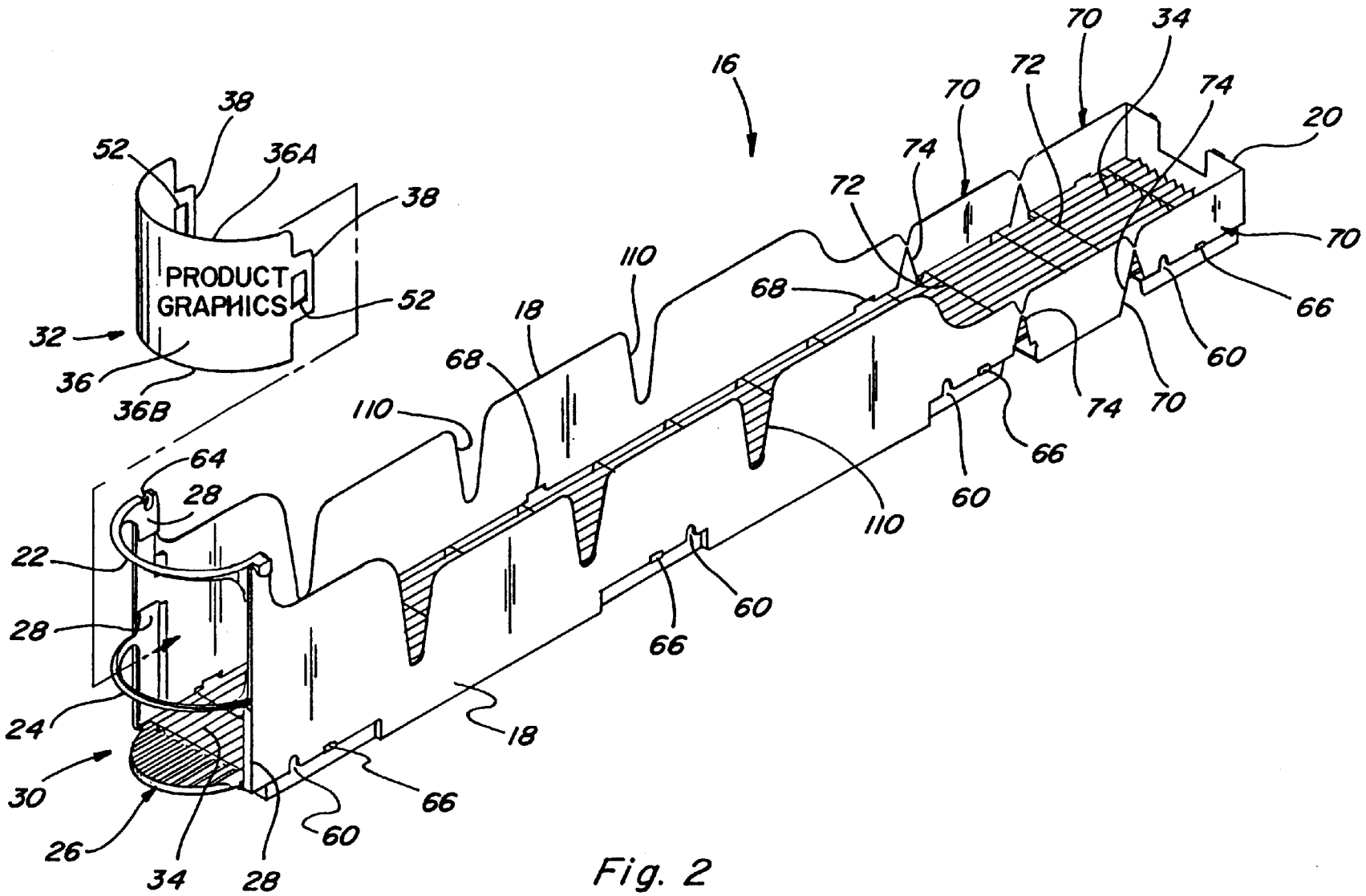
FIG. 2 is a perspective view of one of the product modules illustrated in FIG. 1, such product module having one product channel associated therewith and its construction being representative of one embodiment of the product modules illustrated in FIG. 1.

Referring primarily to FIGS. 2–8, one embodiment of product module 16 includes spaced upstanding guide members or side walls 18, a rear wall or edge portion 20, a pair of spaced arcuate front wall members 22 and 24, and a substantially planar floor portion 26 extending therebetween as best shown in FIG. 2. The module side wall members 18 define respectively therebetween a product channel 30 for supporting and guiding products positioned therebetween on the floor portion 26, the wall portions 18 being either integrally formed with or attached to a pair of upright forward posts or reinforcing members 28 located at the front portion of each product channel 30. The forward posts 28 add additional strength and stability to the front portion of each product channel for supporting products positioned against the front wall members 22 and 24 and as more fully explained with respect to the embodiment illustrated in FIG.

18. Use of the upright forward posts 28 is consistent with prior front wall designs associated with many of Applicants' assignee's product merchandising units. Also, importantly, each product channel 30 includes a removably attachable product graphic insert panel 32 as shown in FIG. 2 and as will be hereinafter further explained. In the product modules 12 and 14 illustrated in FIG. 1, each product channel 30 is also defined by the floor portion 26 located between adjacent guide or side wall members 18. The guide or side wall members 18 are preferably integrally formed with the modules 12, 14 and 16 for ease of manufacture and to lend strength and stability to each product module, although other suitable means may be used to attach the guide members 18 to both the module floor structure 26 as well as to the upright posts or reinforcing members 28. The reinforcing members 28 may also be comprised of an area of increased thickness associated with the front portion of each respective side wall 18.

Figure 3:
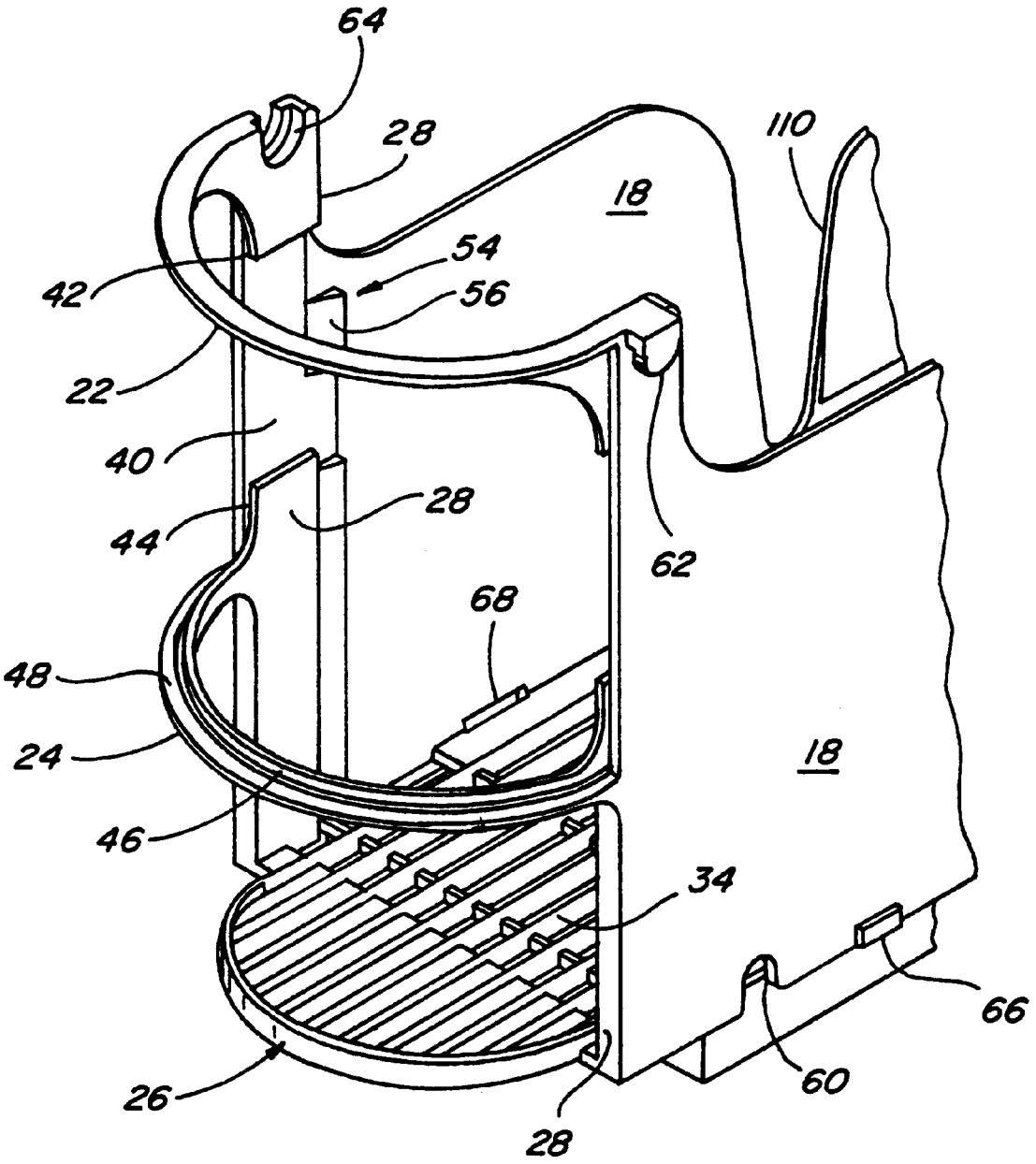
FIG. 3 is an enlarged partial perspective view of the front portion of the product module illustrated in FIG. 2.
Figure 4:
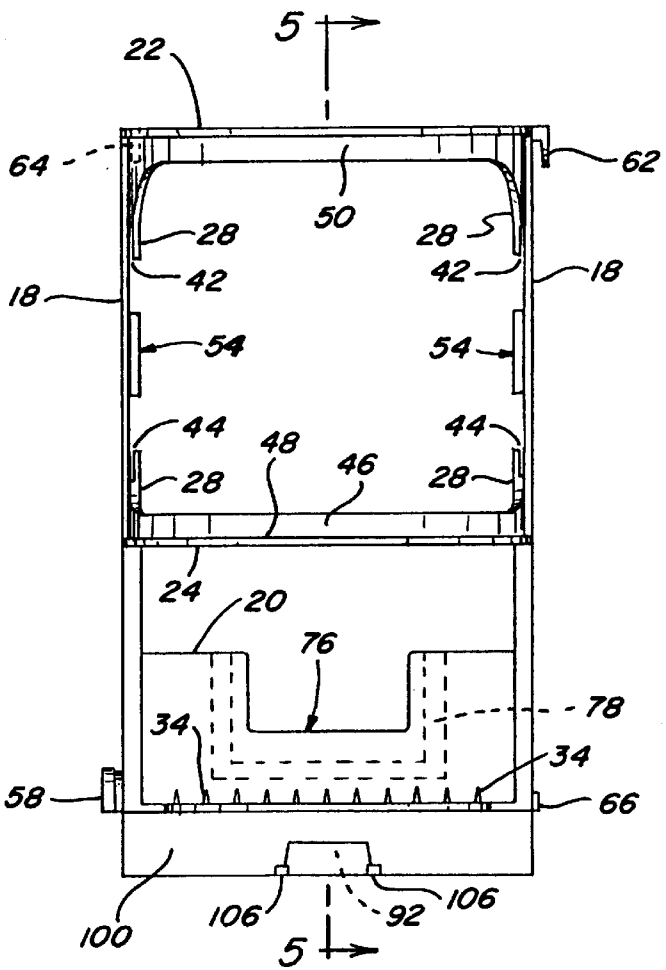
FIG. 4 is a front elevational view of the product module illustrated in FIGS. 2 and 3.

The floor portion 26 of each product module such as the module 16 may take on a wide variety of different configurations including a smooth planar surface or a wide variety of different track means such as the track configuration illustrated in FIGS. 2–4. In its preferred embodiment, the floor portion 26 may include a plurality of spaced longitudinally extending ribs, rails or runners 34 which project upwardly therefrom as best shown in FIG. 4. The upstanding ribs or runners 34 form the respective support surface in each respective product channel 30 upon which products will be positioned for movement therealong. The rails or runners 34 are preferably integrally formed with the module structure such as through an injection molding process or other means for accomplishing this task. Because of the materials and lubricants used in the construction of the rail means 34, the rails or runners 34 reduce the friction between such surfaces and the products positioned thereon thereby improving the slidability of products as they move across such runners from the rear of each module to the front portion thereof. This is particularly important when the present modules are used in a gravity-feed arrangement since products positioned thereon must be able to slide under the force of gravity towards the front portion of each module when the forwardmost products are removed therefrom. The actual construction of the track runners 34 as well as the materials and lubricants used to improve the slidability of products positioned thereon are more fully disclosed and described in U.S. Pat. Nos. 4,801,025; 4,454,949; and 4,416,380, all of which are owned by Applicants' assignee. It is also recognized that the spacing between the individual runners 34 may be varied to accommodate any and all of the various products that are to be positioned thereon regardless of the shape or contour of the bottom portions associated with such products.

Figure 5A:
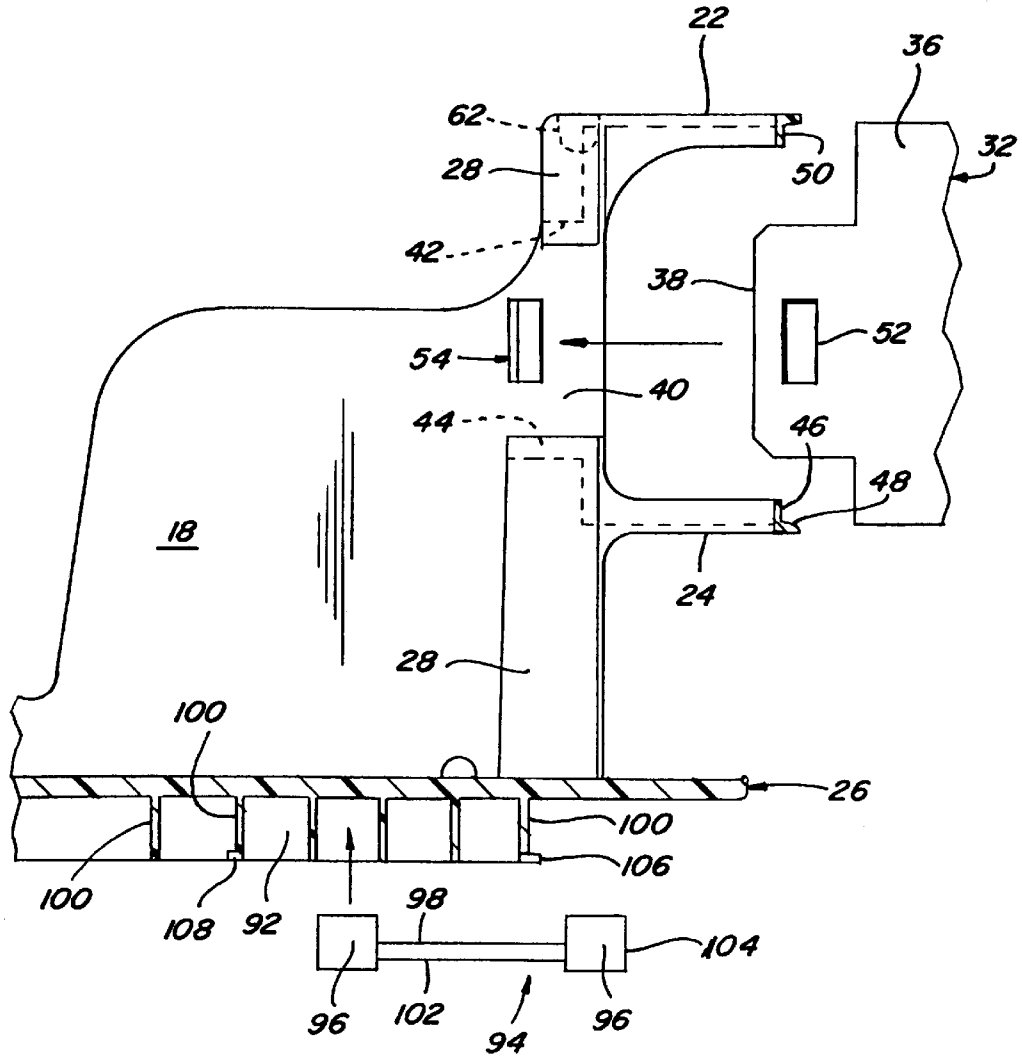
FIG. 5A is a fragmentary cross-sectional view of the product module of FIGS. 2–4 taken along line 5—5 of FIG. 4.
Figure 5B:
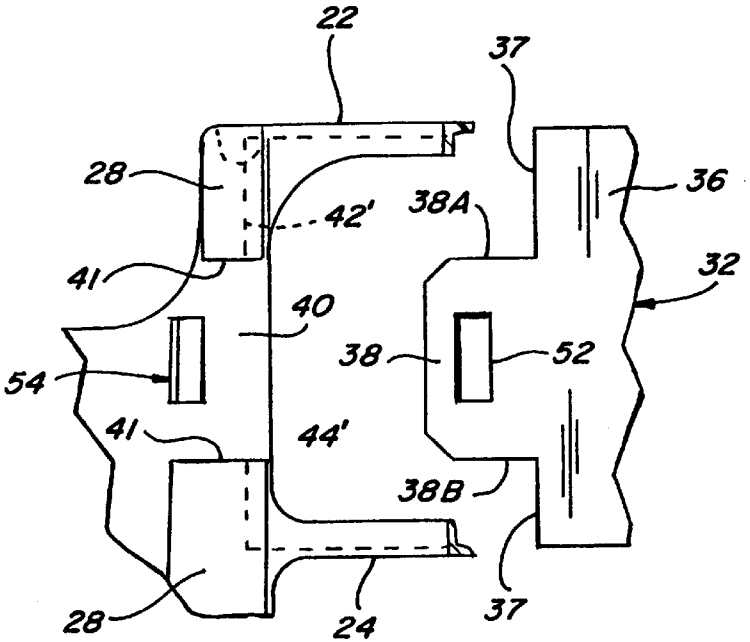
FIG. 5B is a partial cross-sectional view similar to FIG. 5A showing an alternative slot construction for receiving the product graphic insert panel.
Figure 7:
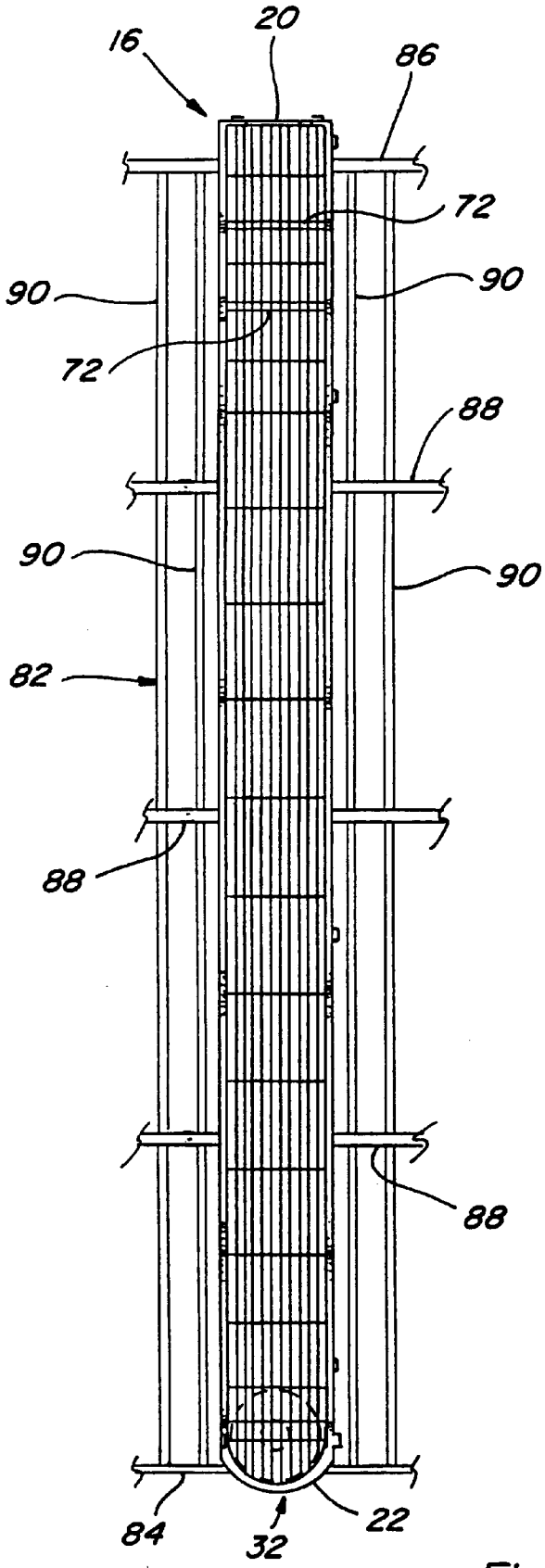
FIG. 7 is a top plan view of the product module illustrated in FIG. 2, the product module being shown in one of its operative positions supported by a typical underlying support structure.
Figure 8:
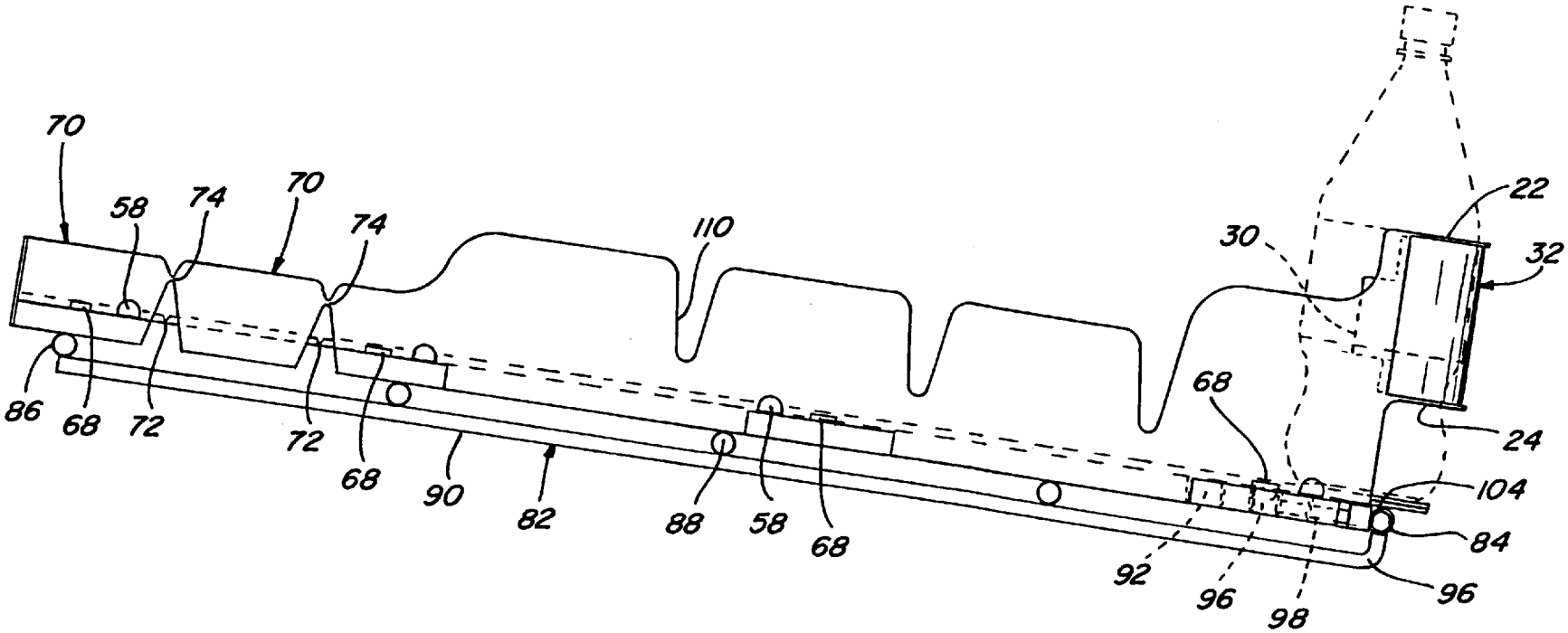
FIG. 8 is a side elevational view of any one of the product modules illustrated in FIG. 1 showing the product module supported in one of its operative positions on top of a typical underlying support structure.

Importantly, each product channel 30 associated with each product module 12, 14, and 16 includes a product graphic insert panel such as the panel 32 illustrated in FIG. 2, which insert panel 32 is removably attachable to the front portion of each product channel 30 as will be hereinafter explained. In the embodiment shown in FIGS. 2–10, the product insert panel 32 is made of a flexible/resilient type of material and includes a main body portion 36 and a pair of tab portions 38 as best shown in FIGS. 2, 5A and 5B, the main body portion 36 being specifically sized and shaped so as to receive the product graphics associated with any particular product placed in any one of the product channels 30 such as the product graphics and identification associated with soft drink products. Attachment of the product panel 32 to the front portion of each product channel 30 is accomplished through the use of a notched or recessed area 40 formed in each post member 28 as best shown in FIG. 3, each notched portion 40 defining a pair of slots 42 and 44 designed to insertably receive one of the tab portions 38 associated with the product insert panel 32. In this regard, the arcuate front members 22 and 24 are strategically positioned heightwise adjacent the front portion of each product channel 30 so as to mate with the upper and lower main body portions 36A and 36B of the product insert panel 32 as best illustrated in FIG. 8. In addition, the front arcuate member 24 includes at least a partially extending raised projection 46 which forms an abutment surface for mating with the lower portion 36B of the insert panel 32 when the panel 32 is operatively engaged with each product channel 30. The upper surface 48 of the arcuate front member 24 likewise forms an abutment surface for mating with and supporting the lower edge portion 36B of the insert panel 32 when similarly engaged therewith. In similar fashion, as best shown in FIGS. 3 and 4, the front arcuate member 22 likewise includes a downwardly extending projection 50 similar to projection 46 which similarly provides an abutment surface for the upper portion 36A of product insert panel 32. The abutment projections or surfaces 46 and 50 provide sufficient resistance and additional support to the insert panel 32 thereby preventing the panel 32 from being inadvertently pushed into the respective product channel 30 during use in a merchandising environment.

Each tab portion 38 associated with the product insert panel 32 likewise includes an elongated opening 52 as best shown in FIGS. 2, 5A and 5B, the openings 52 being positioned and located so as to cooperatively engage a corresponding projection 54 associated with each notched portion 40 of each post or reinforcing member 28. In the particular embodiment illustrated in FIGS. 2–5, the projection 54 includes an inclined surface 56 which is designed to help guide the respective tab portions 38 up and over the back edge portion of the projection 54 such that the corresponding elongated opening 52 can be engaged therewith. When the tab portions 38 are respectively inserted within the slots 42 and 44 and moved rearwardly such that the main panel body portion 36 engages the abutment surfaces 46 and 50 associated with the front arcuate members 22 and 24, the elongated openings 52 will simultaneously engage the projections 54 thereby securely holding the insert panel 32 in proper position adjacent the front portion of each product channel 30. Although the projections 54 illustrated in FIGS. 2–5B are shown as including an inclined surface 56, it is recognized and anticipated that a wide variety of conventional means including an elongated bead or other shaped member may be used to engage the openings 52.

It is important to note that the pair of slots 42 and 44 defined by the notched portion 40 illustrated in FIG. 5A extend substantially the full depth of each upright post or reinforcing member 28 such that the upper and lower edge portions of each tab portion 38 associated with the product insert panel 32 will be located within and supported by the respective slots 42 and 44 along their entire length. An alternative configuration of the slots 42 and 44 is illustrated in FIG. 5B wherein the pair of slots 42' and 44' defined by the notched portion 40 do not extend the full depth of each upright post or reinforcing member 28, but instead, the slots 42' and 44' are vertical slots as illustrated in FIG. 5B adaptable to receive the side edge portions 37 associated with panel insert member 32. In this arrangement, the top and bottom edge portions of each tab portion 38, namely, tab edge portions 38A and 38B, will merely lie flush with and slide along the opposed surface portions 41 defined by the respective notched portions 40 as the panel tab portions 38 are moved into engagement with the projections 54. Although either slot configuration illustrated in FIGS. 5A and 5B will work equally well for holding the product panel 32 in its operative position, it is recognized and anticipated that a wide variety of other constructions including other slot arrangements can likewise be utilized to securely hold the panel member 32 in operative position adjacent the front portion of each product channel 30.

Since engagement of the openings 52 with the projections 54 provides sufficient support for holding the product graphic insert panel 32 in proper position adjacent the front portion of each product channel 30, it is also recognized and contemplated that the abutment surfaces 46 and 50 associated with front members 22 and 24 may be eliminated and the upper and lower portions 36A and 36B of the panel insert 32 may merely lie flush with and at least partially overlap or mate with the front surface portion of each of the members 22 and 24. In this regard, the thickness of the front members 22 and 24 may be varied to provide sufficient mating surfaces for preventing the insert panel 32 from being inadvertently pushed rearwardly into the product channel 30 during use. Still further, it is also recognized and anticipated that the front arcuate member 24 may likewise be eliminated and that the front member 22 in cooperation with the engagement of the panel tab portions 38 with the projections 54 will provide sufficient security for adequately holding and supporting the product insert panel 32 adjacent the front portion of each respective product channel 30. In this particular situation, the bottom portion of each of the lower slots 44 (FIG. 5A), or the lower surface portion 41 (FIG. 5B), will likewise provide additional support for securely holding the panel 32 in its operative position.

Since the present product modules 12, 14 and 16 are specifically designed for use in displaying and merchandising soft drink products to consumers, the front members 22 and 24 as well as the product insert panel 32 are specifically sized, shaped and configured so as to correspond substantially identically with the product identification and graphics associated with any particular soft drink product container, see FIG. 8. For this reason, the front members 22 and 24 are shown to be arcuate in shape and the product insert panel 32 preferably should be made of a flexible, resilient type material so that it can be easily flexed and manipulated into the slots 42/42' and 44/44' so as to conform to the arcuate shape of the front members 22 and 24. Also, importantly, the members 22 and 24 are strategically spaced above the floor portion 26 so as to substantially coincide with the upper and lower extremities of the product graphics and identification associated with a particular sized soft drink product, see FIG. 8. Typically, the product graphics associated with a particular soft drink product is positioned and located on the product container towards the center or upper portion thereof. The front members 22 and 24 as well as the insert panel 32 are positioned and configured such that when the insert panel 32 is engaged with a respective product channel 30 and the appropriate product graphics and identification for a particularly sized soft drink container are stencilled or otherwise affixed to the main body portion 36 of the panel 32, the main panel body portion 36 will substantially overlay the product graphics and identification associated with the lead soft drink container. This means that each product module 12, 14 and 16 can be specifically designed for displaying and merchandising a particularly sized soft drink product container, such as 12 oz., 16 oz., 20 oz., 1 liter and other soft drink product container sizes, and the front members 22 and 24 as well as the product insert panel 32 can be sized, shaped and strategically positioned as described above so as to substantially overlay the product graphics and identification associated with the actual soft drink product container positioned therebehind.

It is further anticipated that a plurality of the present product insert panels 32 will be provided with the present assemblies, such plurality of removably insertable panels 32 including the product graphics and identification associated with a multitude of different soft drink products. Depending upon which soft drink product is being merchandised from any particular product channel 30, the appropriate insert panel 32 depicting the proper product graphics and identification can be installed adjacent the front portion of each product channel 30 as previously explained. When the appropriate insert panel 32 is operatively engaged with a particular product channel 30, such insert panel will hide the actual product graphics associated with the lead article positioned therebehind, regardless of its actual orientation relative to the front of each product channel, and the graphics associated with the product insert panel 32 will always present an attractive and centered product identification and graphics.

The product insert panel 32 can be easily removed and replaced with another insert panel 32 by simply releasing the panel openings 52 from engagement with the projections 54 and thereafter slidably moving the insert panel 32 forward away from the front members 22 and 24. A replacement panel 32 including different product graphics or other indicia may thereafter be re-engaged with the front members 22 and 24 and the projections 54 as previously explained above.

Each product module 12, 14 and 16 likewise includes cooperatively engageable interlocking connection means associated with the respective outer side edge portions of each such product module in the form of a plurality of friction grip keepers 58 as well as a plurality of corresponding slots 60 as best shown in FIGS. 1–4, 8 and 9. The keepers 58 and corresponding slots 60 may be configured in accordance with the teachings and practice of U.S. Pat. No. 5,624,042, which patent is likewise assigned to the present assignee. Although use of the keepers 58 and slots 60 as disclosed in U.S. Pat. No. 5,624,042 are generally preferred, it is also recognized and anticipated that a wide variety of conventional mechanisms may be used to secure the product modules 12, 14 and 16 in a side-by-side columnar array such as those mechanisms disclosed in U.S. Pat. Nos. 4,685,574; 4,785,945; 5,050,748; 5,634,564 and 5,645,176. Still other intercoupling means may be equally as suitable, each having their own special advantages and disadvantages.

Each product module likewise includes an additional friction keeper 62 located adjacent the upper edge forward portion of each product channel side wall 18 or member 28 as best illustrated in FIGS. 2–5A, the friction keeper 62 being cooperatively engageable with a corresponding keying slot 64 located in opposed relationship adjacent the upper edge forward inner portion of the opposed side wall 18 or member 28 as likewise shown in FIGS. 2–4. Although use of the interlocking means 62 and 64 is optional, such use provides greater stability and security to the upper forward portion of two adjacent product modules particularly when such product modules are designed for displaying and merchandising the taller soft drink products. Here again, it is recognized that a wide variety of locking means can be utilized in place of keeper member 62 and its corresponding keying slot 64, and such other means may likewise work equally as well.

Each product module 12, 14 and 16 may likewise optionally include a separate locking mechanism associated with each of the present modules for preventing inadvertent separation when two such modules are coupled together. This additional locking mechanism is best illustrated in FIGS. 2–4, 8 and 9 and includes at least one outwardly or laterally extending flange or projection 66 (FIGS. 2 and 3) associated with one outer side wall portion 18 of any of the present modules and a corresponding recess or cavity 68 (FIGS. 2, 3 and 8) associated with the opposite outer side wall portion of such modules. The recess or cavity 68 is positioned in opposed relationship to its corresponding projection 66 and is dimensioned so as to receive the projection 66 when adjacent modules arc coupled together. The projections 66 are designed to push against the outer side wall 18 associated with an adjacent module as the keying slots 60 are moved progressively downwardly into engagement with the keeper members 58 such that when the present slots 60 are fully engaged with their corresponding keeper members 58, the projections 66 will simultaneously engage the recesses 68. When so engaged, the projections 66 will engage the bottom edge of the recesses 68 and prevent one module from inadvertently moving upwardly towards a disengaged position due to product weight or other factors. Disengagement of two interlocked modules can be easily accomplished by merely exerting a slight sideward force between two adjacent modules so as to remove the projections 66 from within their corresponding recesses 68 before exerting upward movement to disengage the present keying slots 60 from their respective keeper members 58. It is recognized and anticipated that any plurality of projections 66 and corresponding recesses 68 can be positioned and located along the length of each respective outer side wall portion of any particular product module and that such projections 66 and corresponding recesses 68 can be located anywhere along the length of such modules.

Each product module 12, 14 and 16 may likewise optionally include any plurality of frangible rear portions 70, each frangible rear portion 70 being defined by a weakened fracture line 72 as best illustrated in FIGS. 1, 2, 7 and 8. The fracture lines 72 extend substantially between the opposed side walls associated with each product module at intermediate locations spaced between the front and rear portions respectively thereof as shown in FIGS. 1, 2, 7 and 8. Each fracture line 72 may include a thin-walled section of reduced cross-sectional area which can be easily fractured and removed through use of a bending motion. In this regard, each side wall 18 likewise includes an area of reduced cross-section such as the reduced cross-sectional area 74 which is generally positioned adjacent the weakened fracture line 72 on both opposite sides of each product channel 30 as best illustrated in FIGS. 2 and 8. The reduced cross-sectional areas 74 associated with the respective side walls 18 lie in direct alignment with the fracture lines 72 and facilitate removal of any particular frangible portion 70. The frangible rear portions 70 may be easily detachably removed by pressing downwardly on the rear portion thereof to snap off and sever such rear portions from the remainder of the product module. The reduced cross-sectional areas 74 facilitate separation of the side wall portions 18 associated with the respective frangible portions 70 during the severing process. This enables a user to easily adjust the overall depth of each product module.

Figure 6:
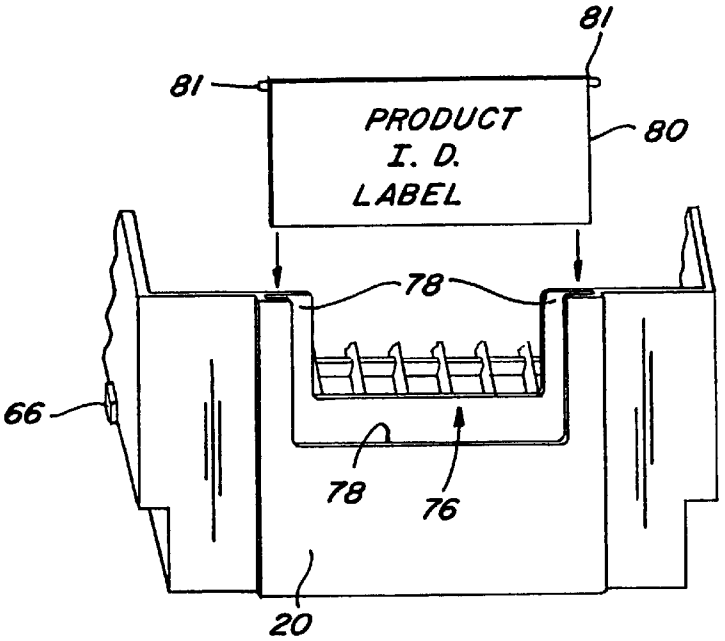
FIG. 6 is a fragmentary perspective view of the rear portion of the product module illustrated in FIG. 2, which rear portion is representative of any one of the product channels associated with any one of the product modules illustrated in FIG. 1.

Referring to FIGS. 4 and 6, the rear wall portion 20 of each product module may likewise include a recessed area 76 defining a slot or channel 78 adaptable for insertably receiving and holding product identification means such as the product label 80 illustrated in FIG. 6. Since the present product graphic insert panel 32 associated with the front portion of each product channel 30 will identify a specific product brand for that particular product channel, it is imperative that all of the product containers positioned within a particular product channel 30 be of the type identified on the front panel 32. Since many of the refrigerated coolers which will utilize the present modules 12, 14 and 16 are loaded from the rear of such coolers, use of the rear product identification label 80 will facilitate the proper loading and restocking of each product channel 30. Like the insert panel 32, the product label 80 or other suitable product identification means is removably replaceable within the slot or channel 78 so as to be compatible with the specific product brand being merchandised from that particular product channel. The product label 80 may optionally include a small projection 81 located on one or both opposite sides thereof as illustrated in FIG. 6, the projections 81 providing a stronger friction fit between the product label 80 and the slot 78 so as to wedge the product label 80 therewithin thereby preventing inadvertent removal or disengagement from slot 78. It is recognized and anticipated that a wide variety of means other than the slot or channel 78 may likewise be utilized to securely hold any type of product identification means such as the product label 80 in operative position adjacent the rear wall 20 of each product channel 30.

The present product modules 12, 14 and 16 are typically supported by an underlying support structure used in conjunction with existing refrigerated cooler equipment. A wide variety of different support shelf structures are utilized with known refrigerated coolers and other types of cold vaults such as, for example, the shelf support structures disclosed in U.S. Pat. Nos. 5,450,971 and 5,645,182. For illustrative purposes only, the present product module 16 is illustrated in FIGS. 7 and 8 as being supported by a typical conventional underlying shelf support structure 82. The underlying shelf structure 82 is composed of a plurality of cylindrical members, rods, wires or the like, secured together with spaces therebetween so as to allow cool refrigerated air to circulate therethrough to the products being merchandised from the present modules. The support structure 82 includes a raised transverse front rod member 84, a rear transverse rod member 86, intermediate transverse rod members 88, and a plurality of laterally spaced longitudinal rod members 90 as shown in FIG. 7. The shelf support structure 82 can be positioned within a typical refrigerated display cooler in either a flat horizontal position or in an inclined position for gravity feeding products positioned thereabove.

Figure 10:
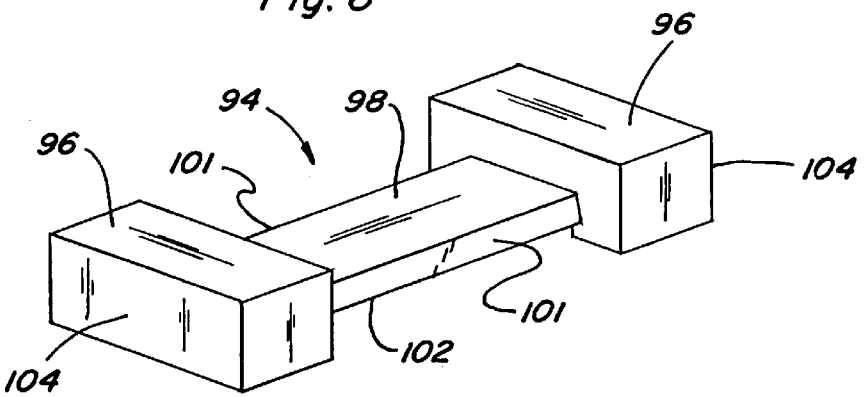
FIG. 10 is a perspective view of the stop member which forms a part of the adjustable mechanism illustrated in FIG. 9.
Figure 9:
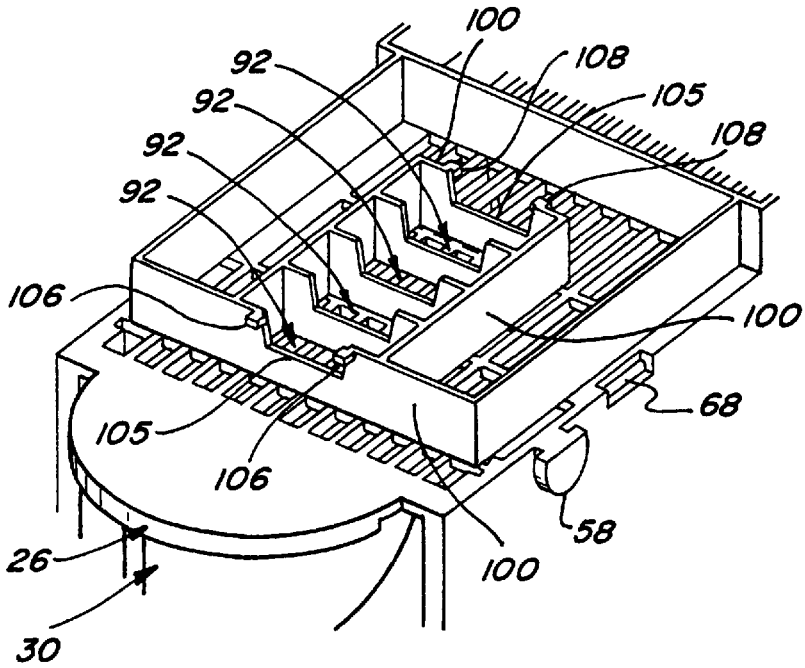
FIG. 9 is a partial perspective view of the underside front portion of the product module illustrated in FIG. 2 showing the adjustable mechanism associated with at least some of the product channels for adjusting the fore and aft position of any one of the product modules illustrated in FIG. 1 relative to the front portion of an underlying support structure.

Since the present modules 12, 14 and 16 are specifically designed for use in conjunction with a wide variety of underlying support structures such as the shelf support structure 82, each product module may optionally include means for adjusting the fore and aft position of such module relative to the transverse front rod member associated with an underlying support structure such as the front rod member 84 of the support structure 82 illustrated in FIGS. 7 and 8. This adjustability is advantageous so that the existing space available between the front portion of the underlying support structure and the cooler doors associated with the known refrigerated display coolers can be effectively utilized depending upon the particular merchandising application. In this regard, the present adjustable mechanism for accomplishing this task includes a plurality of recesses, cavities and/or channels 92 extending transversely across at least a portion of the width of at least one product channel 30 associated with any one of the present modules adjacent the underside portion thereof as best illustrated in FIGS. 5A, 8 and 9. Each cavity or channel 92 is configured and dimensioned so as to cooperatively receive at least one end portion 96 of a substantially I-shaped stop member 94 (FIG. 10) as illustrated in FIGS. 5A and 8. The stop member 94 includes an elongated center portion 98 having substantially identically configured opposite end portions 96 associated therewith, the overall height or thickness of the respective end portions 96 being greater than the overall height or thickness of the elongated center portion 98 as best shown in FIGS. 5A and 10. Either end portion 96 of the stop member 94 may be adjustably positioned within any one of the plurality of cavities or channels 92 as will be hereinafter further explained. In this regard, each of the transverse side walls 100 forming the respective channels 92 includes a recessed or cut-out portion 105 adaptable for receiving the elongated center portion 98 of the stop member 94 when one of the stop member end portions 96 is operatively positioned within any one of the plurality of channels 92. The depth or height of the respective cut-outs 105 associated with the transverse wall members 100 are such that when the elongated center portion 98 of the stop member 94 is received therewithin, the lower edge portion 102 of the elongated center portion 98 will lie substantially flush with the exposed edge portions of the respective channels 92.

As best indicated in FIGS. 8 and 9, the plurality of transversely extending channels 92 are positioned adjacent the front portion of at least one of the product channels 30 associated with any particular module 12, 14 and 16 at a predetermined distance therefrom based upon the overall length of the stop member 94. When one end portion 96 of the stop member 94 is engaged with a respective channel 92 as illustrated in FIGS. 5A and 8, the outwardly facing surface 104 of the other end portion 96 extending forwardly towards the front portion of the product module forms an abutment surface which will be located a predetermined distance aft of the forwardmost portion of a particular product channel depending upon which cavity or channel 92 the stop member 94 is engaged therewith. As shown in FIG. 8, the forward extending abutment surface 104 is designed to rest behind and engage the rear portion of the forwardmost rod member 84 associated with the underlying support structure 82 thereby preventing the present product modules from moving any further forward relative to the underlying support structure. The relative position of the abutment surface 104 can be varied fore and aft depending upon which cavity or channel 92 is selected for engagement with the opposite end portion 96 of stop member 94. This is particularly advantageous as the present modules can be adjustably positioned fore and aft on a particular underlying support structure so as to position the front portion of each product module at any predetermined distance relative to the cooler doors associated with known refrigerated display coolers depending upon the particular spacing desired.

Although the opposite end portions 96 of stop member 94 are preferably frictionally engaged with the respective cavities or channels 92, the present adjustment means may likewise include a pair of forwardly extending projections or tabs 106 as well as a pair of rearwardly extending projections or tabs 108 as best illustrated in FIGS. 5A and 9. These tabs or projections 106 and 108 are positioned and located such that when the center portion 98 of stop member 94 is positioned within the cut-out portion 105 of the forwardmost or rearwardmost side wall portion 100 incorporating the respective projections 106 and 108, such projections will overlap and engage the bottom edge portion 102 of stop member 94. In this regard, the projections 106 and 108 are designed to push against the outer side wall surface 101 of the center portion 98 of stop member 94 as one of the respective stop member end portions 96 is moved progressively downwardly into one of the plurality of transverse channels 92 such that when the stop member end portion 96 is fully engaged or seated within a particular transverse channel 92, the projections 106 or 108 will simultaneously overlap and engage the lower edge portion 102 of the center portion 98 of stop member 94 thereby preventing the member 94 from inadvertently moving downwardly towards a disengaged position with respect to any one of the transverse channels 92. In this regard, the opposed side wall surfaces 101 of stop member 94 may be tapered as illustrated in FIG. 10 so as to facilitate engagement of the projections 106 or 108 with the respective bottom edge portions 102. Disengagement of the stop member 94 with any one of the transverse channels or cavities 92 can be easily accomplished by merely exerting a slight downward force on the stop member 94 so as to move the respective bottom edge portions 102 past the overhanging projections 106 or 108.

It is recognized and anticipated that any plurality of projections 106 or 108 can be positioned and located along any of the transverse side walls 100 forming the respective channels 92 to further secure the stop member 94 when engaged with any one of the channels 92. Still further, it is recognized and anticipated that still other means may likewise be utilized to further secure the stop member 94 in any one of its operative positions. When it is determined that the stop member 94 need not be utilized in a particular merchandising situation, or if it is determined that the forwardmost transverse side wall 100 incorporating the projections 106 as best illustrated in FIG. 9 can be utilized as the surface for abutting the forwardmost rod member 84 associated with the underlying support structure 82, the stop member 94 can be engaged with any one of the plurality of channels or cavities 92 such that the elongated center portion 98 will engage the rearwardly extending projections 108. This orientation will secure the stop member 94 in a storage position for future use.

Although each product module 16 will include the fore and aft adjustment means 92 and 94, it is recognized and anticipated that the product modules 12 and 14 will not necessarily have the present adjustment means 92 and 94 associated with each respective product channel 30 incorporated therewithin. For example, the product module 12 may have the present means 92 and 94 associated with only three out of the five product channels associated therewith whereas product module 14 may have the present adjustment means 92 and 94 associated with either one or both of the product channels associated therewith. Regardless of the specific configuration associated with any of the present product modules, use of the present adjustment means 92 and 94 provides more space up front below floor portion 26 for removing product containers located in product channels positioned therebelow. Other variations and configurations may likewise be utilized without departing from the spirit and scope of the present invention.

Each of the parallel side wall members 18 associated with the present product modules 12, 14 and 16 may likewise be constructed optionally so as to be taller in overall height as well as flexible and/or resilient. In addition, each side wall 18 may also include one or more slots or notches 110 as best shown in FIGS. 2, 3 and 8 located at spaced locations along at least a portion of the length of each side wall 18, each slot or notch 110 extending in a vertical orientation as illustrated. The taller resilient product side walls 18 provide lateral support for taller products positioned in the respective product channels 30 so as to prevent such taller products from tipping or toppling over the respective divider walls into adjacent products or channels as such products are removed therefrom. Also, importantly, the side walls 18 serve to guide and direct any movement of the products along the respective channels 30 as the flexibility of the side walls 18 enables smooth, free and unrestricted movement of the products within the channels 30 without binding, squeezing or otherwise hindering the product flow, particularly, in a gravity-feed situation. The specific function and constructional details associated with the taller flexible slotted side walls 18 as well as variations thereof are fully explained and disclosed in U.S. Pat. No. 5,351,838, which patent is likewise assigned to the present assignee.

Figure 11:
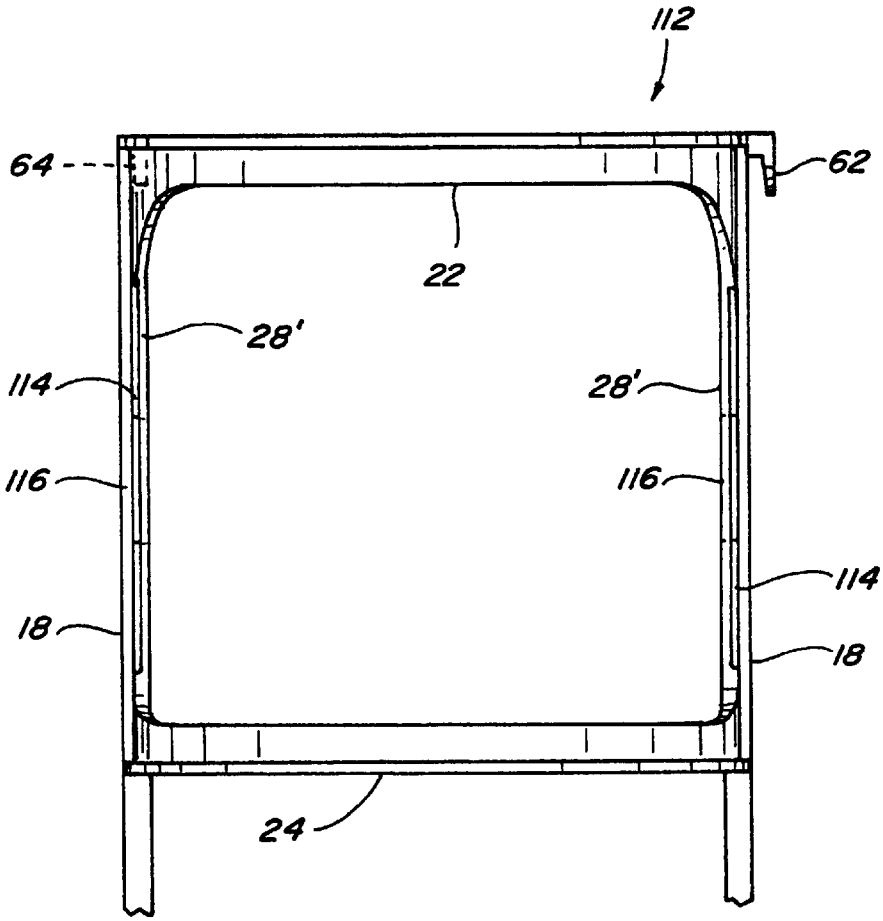
FIG. 11 is a partial front elevational view illustrating another embodiment of the present product modules constructed according to the teachings of the present invention.

FIG. 11 discloses another embodiment 112 of the present product modules 12, 14 and 16, the module 112 being substantially similar in construction and operation to the product modules 12, 14 and 16 but differs therefrom only in the design and construction of the upper front portion of each product channel 30. More specifically, the product module 112 likewise includes spaced upstanding side walls 18, a pair of spaced arcuate front wall members 22 and 24, and a pair of upstanding posts or reinforcing members 28' as shown in FIG. 11. The front portion of product module 112 differs from the front portion of product modules 12, 14 and 16 in that the notched or recessed area 40 associated with reinforcing members 28 (FIG. 3) has been eliminated and a full length slot 114 has been incorporated into the front portion of the module 112 as illustrated replacing the upper and lower slots 42 and 44 associated with product modules 12, 14 and 16. The slots 114 can be formed into the side walls 18, the reinforcing member 28', or such slots can be located between the reinforcing members 28' and the corresponding product channel side walls 18. In all other respects, the construction and operation of product module 112 is substantially identical to the construction and operation of product modules 12, 14 and 16. This means that the tab portions 38 associated with the product insert panel 32 can be insertably positioned through the slots 114 so as to again cooperatively engage a corresponding projection 116 positioned on or adjacent to the posts or reinforcing members 28', the projection 116 being substantially similar to the projection 54. Attachment and removal of each product insert panel 32 adjacent the front portion of the product channel associated with product module 112 including the mating relationships between the product insert panel 32 and the members 22 and 24 are the same as described above with respect to product module 16. Use of the full length slot 114 and a full length post or reinforcing member 28' on each opposite side of each product channel 30 adds additional strength and stability to the particular product module and provides still additional support for holding the product graphic insert panel 32 in proper position adjacent the front portion of the product channel. All of the structural variations and configurations regarding the front members 22 and 24 discussed above with respect to product modules 12, 14 and 16 are likewise equally applicable with respect to product module 112.

It is also recognized and anticipated that the projections 54 and 116 associated with product modules 12, 14, 16 and 112 can be sufficiently sized and dimensioned such that engagement of these projections with the panel tab openings 52 will provide more than enough security for adequately holding and supporting the product insert panel 32 adjacent the front portion of any particular product channel in and of itself. In this particular situation, the slots 42/42', 44/44' and 114 can be totally eliminated and the panel tab portions 38 can merely lie flush adjacent the inner surface of each respective side wall 18 or post 28 when the panel tab portions are engaged with their corresponding projections. Although use of the slots 42/42', 44/44' or 114 provide additional stability and rigidity to the panel insert member 32 when operatively engaged with the front portion of any particular product channel, still other means for securely holding the panel 32 in operative position adjacent the front of each product channel may likewise be utilized.

Figure 12:
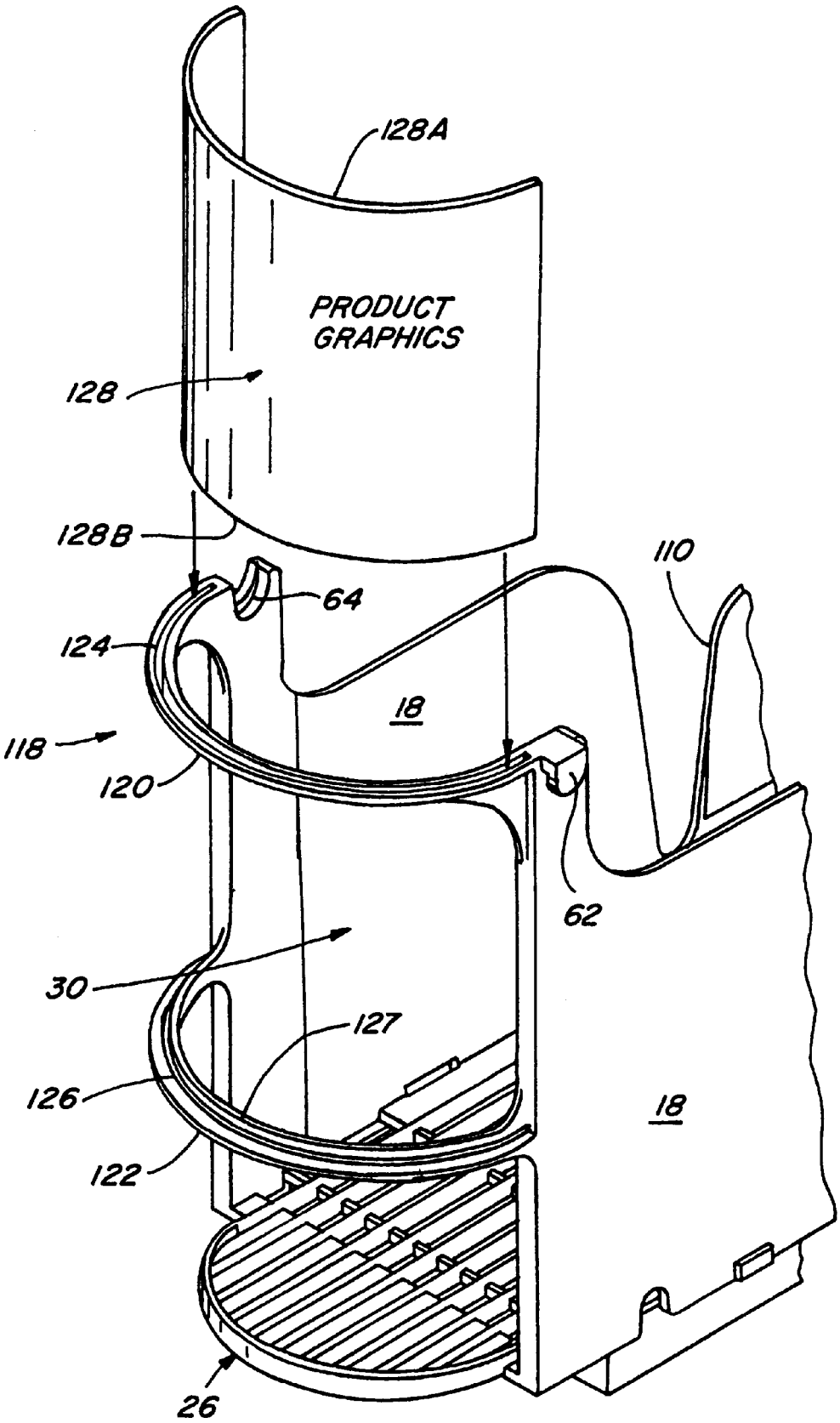
FIGS. 12, 13, 14 and 15 are partial perspective views illustrating still other embodiments of the present product modules including other embodiments of the product graphic insert panel associated therewith.

FIG. 12 discloses still another embodiment 118 of the present modules 12, 14 and 16 wherein the front portion of the module 118 is likewise adaptable for receiving and holding a product insert panel such as the panel 128. The product module 118 includes a pair of spaced arcuate front wall members 120 and 122, the front member 120 including an arcuate slot 124 formed therethrough whereas front member 122 includes an arcuate groove or channel 126 formed therein. In this particular embodiment, the panel insert member 128 is specifically shaped and dimensioned so as to be inserted through the slot 124 such that its bottom edge portion 128B will be insertably received into and supported within the groove or channel 126 associated with front member 122. Like the product insert panel 32, the product insert panel 128 is preferably made of a flexible/resilient type of material such that it can be easily flexed and manipulated for insertion through slot 124 and into channel 126 so as to conform to the arcuate shape of the front members 120 and 122. In this particular embodiment, the upper and lower portions 128A and 128B of the insert panel 128 at least partially overlap and lie flush with the abutment surfaces formed by the respective slot 124 and channel 126. Here again, the thickness of the front members 120 and 122 as well as the thickness or height of the slot 124 and channel 126 may be varied so as to provide sufficient mating surfaces for preventing the insert panel 128 from being inadvertently pushed rearwardly into the product channel 30 during use. In this regard, the front member 122 may also optionally include an abutment surface 127 similar to abutment surface 46 (FIGS. 3 and 4) for mating with and supporting the lower edge portion 128B of insert panel 128. Also, importantly, similar to the position and location of front members 22 and 24, the members 120 and 122 are likewise strategically spaced above the floor portion 26 so as to substantially coincide with the upper and lower extremities of the product graphics and identification associated with a particular sized soft drink product positioned within the product channel 30. Like product insert panel 32, the insert panel 128 can likewise be easily removed and replaced with another insert panel 128 by simply slidably moving the panel 128 upwardly through the slot 124. A replacement panel 128 including different product graphics or other indicia may thereafter be re-engaged with the front members 120 and 122 as previously explained. In all other respects, the construction and operation of product module 118 is substantially similar to the construction and operation of product modules 12, 14, 16 and 112.

Figure 13:
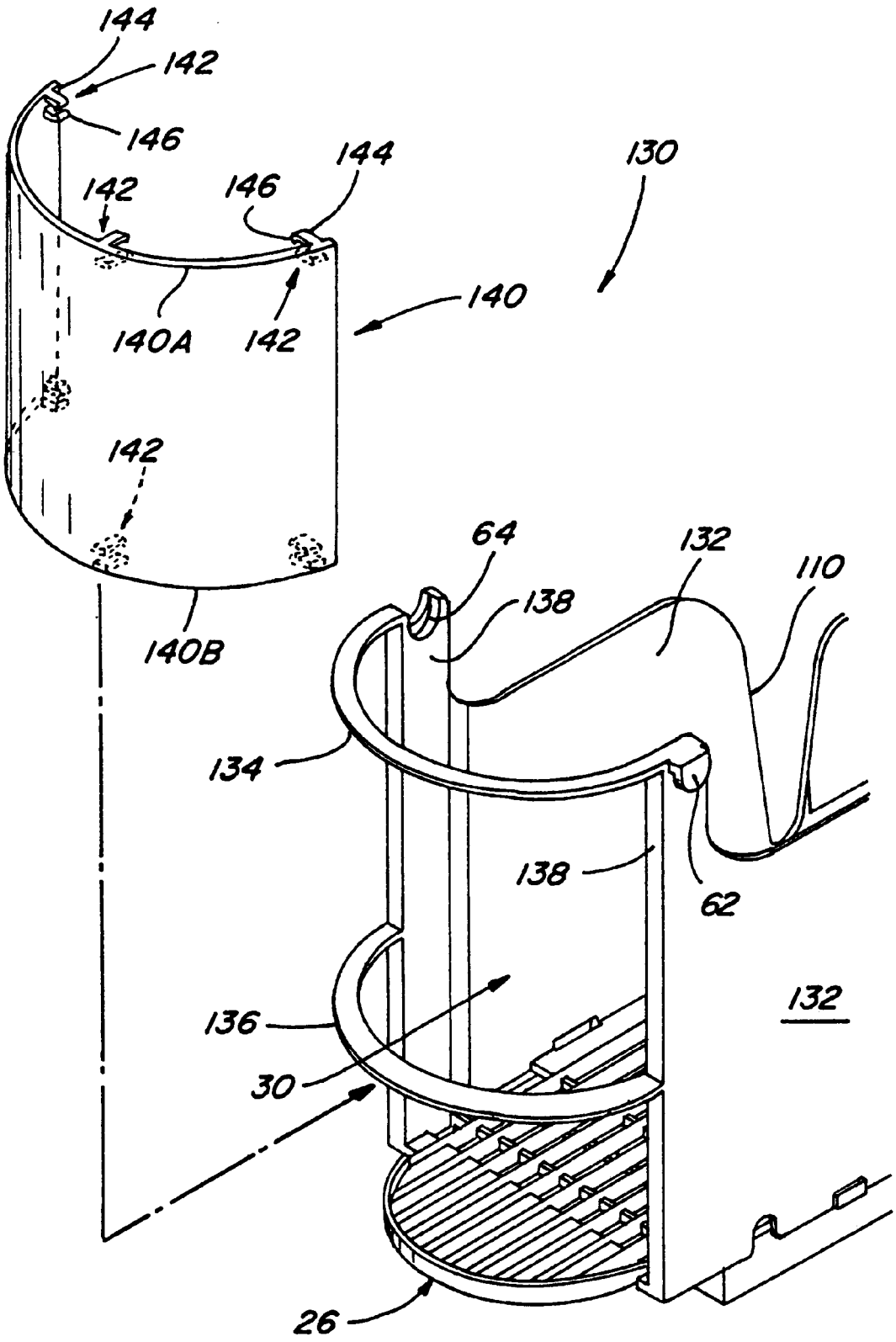

FIG. 13 discloses still another embodiment 130 of the present product modules 12, 14 and 16 wherein again the front portion of the product module has been modified to receive and accept another embodiment of the present product graphics insert panel. In the embodiment disclosed in FIG. 13, the product module 130 includes spaced upstanding side walls 132, a pair of spaced arcuate front wall members 134 and 136, and a substantially planar floor portion 26 extending between the side walls 132. Like the product modules 12, 14 and 16, the side walls 132 define therebetween a product channel 30 for supporting and guiding products positioned on the floor portion 26 and may include a reinforcing member or post 138 adjacent the front portion thereof similar to the reinforcing members 28 and 28'. The side walls 132 may be either integrally formed with or attached to the posts or reinforcing members 138 if such reinforcing members are utilized in this particular construction.

Similar to the product insert panel 32, the insert panel 140 illustrated in FIG. 13 is likewise made of a flexible/resilient type material and includes a plurality of cooperatively engageable fastening means 142 located in spaced apart relationship adjacent the upper and lower panel edge portions 140A and 140B as illustrated in FIG. 13. The fastening members 142 are positioned and located so as to engage the respective front members 134 and 136 when positioned in abutting relationship thereagainst. More specifically, each fastening means 142 includes a pair of inwardly extending fingers 144 each having a projection or overhanging flange portion 146 associated with its terminal end portion. The fingers 144 are specifically spaced and dimensioned so as to insertably receive therebetween the corresponding front members 134 and 136 such that when the upper and lower portions 140A and 140B of insert panel 40 are positioned in flush mating relationship against the front surfaces of members 134 and 136, the overhanging flange portions 146 associated with the fastening means 142 will overlap and engage the back edge portion of the respective front members 134 and 136 thereby securely holding the insert panel 140 in operative position thereagainst. In this regard, the fastening fingers 144 should be made of a resilient material such that they can be easily snap-fitted onto and removed from the front members 134 and 136.

As previously explained, the members 134 and 136 are strategically spaced above the floor portion 26 so as to substantially coincide with both the upper and lower edge portions 140A and 140B of product insert panel 140 as well as with the upper and lower extremities of the product graphics and identification associated with a particular sized soft drink product. Like the product insert panel 32, the panel 140 can likewise be easily removed and replaced with another insert panel 140 so as to properly depict the appropriate product graphics and identification of the particular soft drink products merchandised therebehind. It is recognized and anticipated that a wide variety of other equally suitable fastening means such as the fastening means 142 may be utilized in conjunction with insert panel 140 to securely hold such panel in operative position adjacent the front portion of each product channel 30 associated with product module 130. In all other respects, the construction and operation of product module 130 is substantially similar to the construction and operation of product modules 12, 14, 16, 112 and 118.

Figure 14:
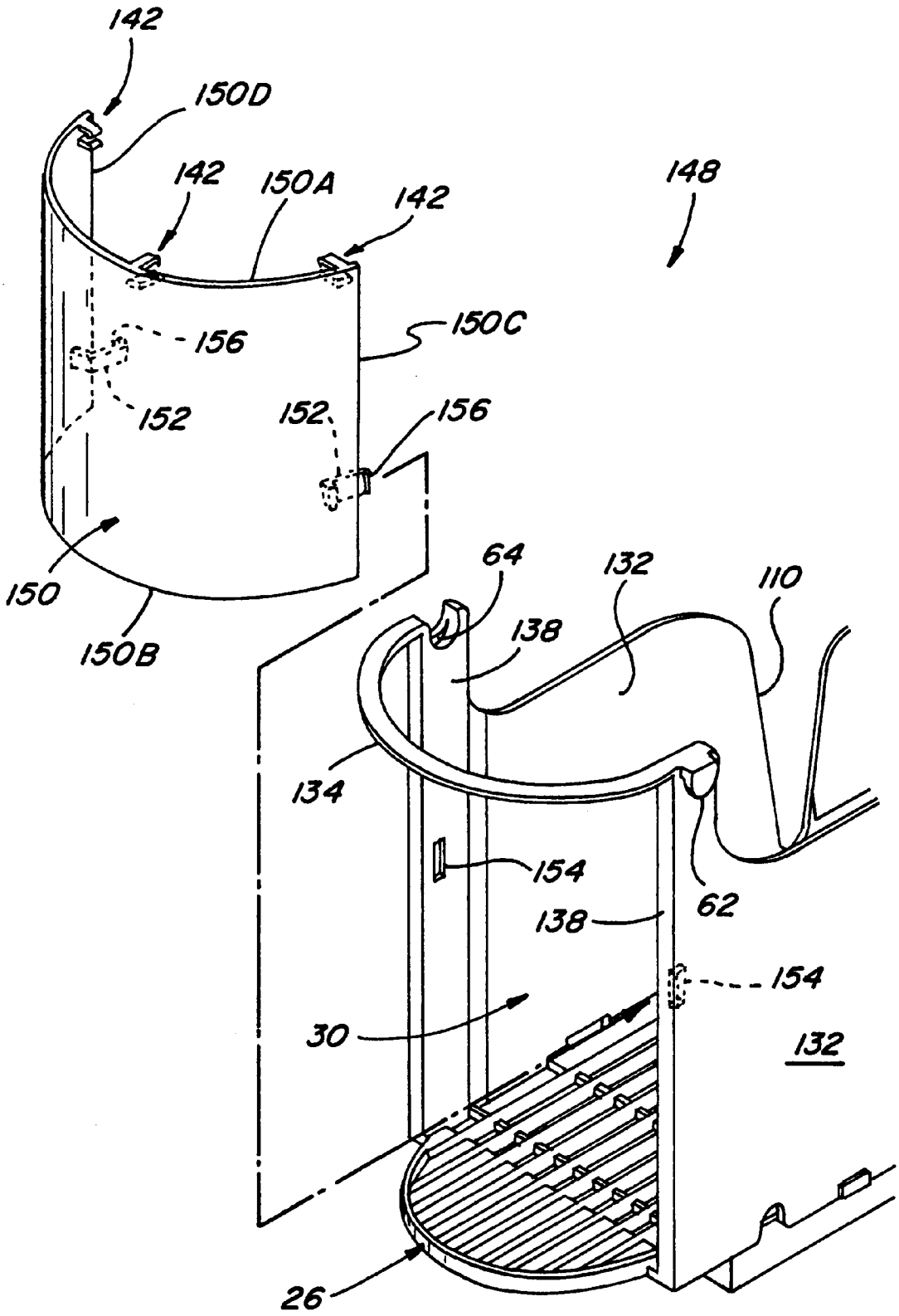

The product module 148 illustrated in FIG. 14 is likewise substantially similar in construction and operation to the product module 130 illustrated in FIG. 13 but differs therefrom only in that the lower front member 136 has been eliminated. In certain merchandising applications, use of a single front support member such as the member 134 may be more than adequate to both properly restrain the product containers positioned therebehind within any particular product channel 30 and provide adequate support for securely holding the product insert panel such as the panel 150 in operative position adjacent the front portion of each product channel 30. In this particular situation, product insert panel 150 likewise includes a plurality of fastening means 142 adjacent the upper portion 150A of panel 150. Engagement of the fastening means 142 with the front arcuate member 134 is identical to that previously described with respect to embodiment 130 (FIG. 13). In addition, the insert panel 150 may optionally include additional fastening means 152 located adjacent the opposed side edge portions 150C and 150D for engagement with suitable means located adjacent the front edge portion of the respective side walls 132 forming each respective product channel 30. In this regard, the forward portion of each respective side wall 132 may include a corresponding slot or recessed cavity 154, on the inner surfaces thereof, for cooperatively receiving and engaging the projections or overhanging flange portions 156 associated with fastening means 152. Any plurality of cooperatively engageable fastening means 152 and 154 may be positioned and located along the length of the respective side edge portions 138, 150C and 150D for cooperative engagement with each other. Like the attachment means 142, it is likewise recognized and anticipated that a wide variety of cooperatively engageable fastening mechanisms may likewise be equally employed in place of the attachment means 152 and 154 illustrated in FIG. 14. In all other respects, the construction and operation of the product module 148 is substantially similar to the construction and operation of product module 130 (FIG. 13).

Figure 15:
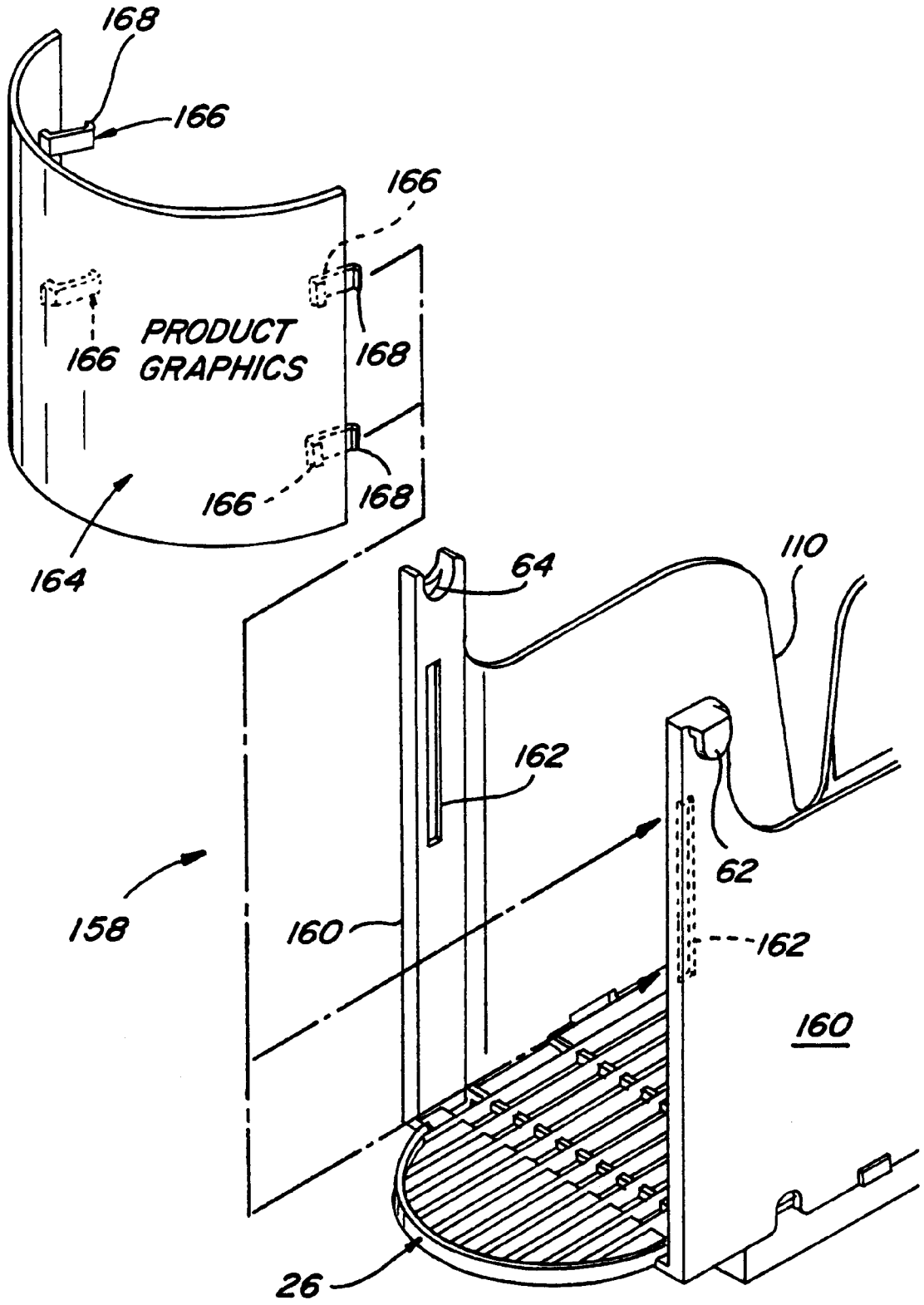

Still further, in some merchandising applications, it may likewise be possible to totally eliminate the front arcuate members 134 and 136 illustrated in FIGS. 13 and 14, and utilize a product insert panel which is attachable directly to the side walls associated with each product channel. This embodiment is illustrated in FIG. 15 wherein the product module 158 includes respective side walls 160 having cooperatively engageable means 162 associated therewith adaptable for receiving and engaging correspondingly positioned fastener means 166 associated with product insert panel 164. The fastening means 166 may be substantially identical to the fastening means 152 associated with embodiment 148 (FIG. 14), or such fastening means 166 may take on a wide variety of other equally suitable constructions. The cooperatively engageable means 162 may include an elongated slot or recessed cavity similar to the recessed cavity 154 (FIG. 14), or such means 162 may include indentations, openings, eyelets, or other suitable means for cooperatively receiving and engaging appropriate means associated with the fastening members 166 such as the projections or overhanging flange portions 168 associated therewith. Although product module 158 is particularly suited for merchandising applications where the module 158 will be used on a flat shelf surface, the product insert panel 164 as well as the cooperatively engageable attachment means 162 and 166 may be sufficiently strengthened such that the product module 158 may likewise be utilized on an inclined support structure for gravity feed operations. In this particular situation, when used for gravity feeding products from product module 158, the product graphic panel 164 will also function as a stop member for holding and retaining products positioned within the respective product channels 30. In this regard, it is important that the attachment means 162 and 166 utilized for removably attaching the insert panel 164 to the front portion of each respective product channel 30 be such that the weight and force of the product containers positioned within any particular product channel 30 and resting against the product insert panel 164 will not cause the panel 164 to become disengaged from the module side walls 160. In this regard, the recessed slot or cavity 162 may extend completely through the side wall 160 so as to provide additional engagement of the flange portions 168 within the cavity 162. In all other respects, the construction and operation of product module 158 is substantially similar to the construction and operation of product modules 130 and 148.

Figure 17:
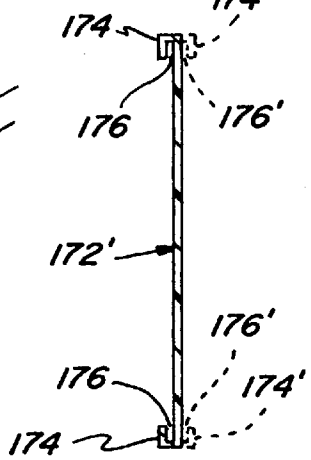
FIG. 17 is a cross-sectional view of the front wall member of a product module similar to the product module of FIG. 16 taken along line 17—17 of FIG. 16, the solid outline portion of FIG. 17 representing a further embodiment of the front wall member of FIG. 16 and the dotted outline portion of FIG. 17 representing still another embodiment of the front wall member of FIG. 16.
Figure 16:
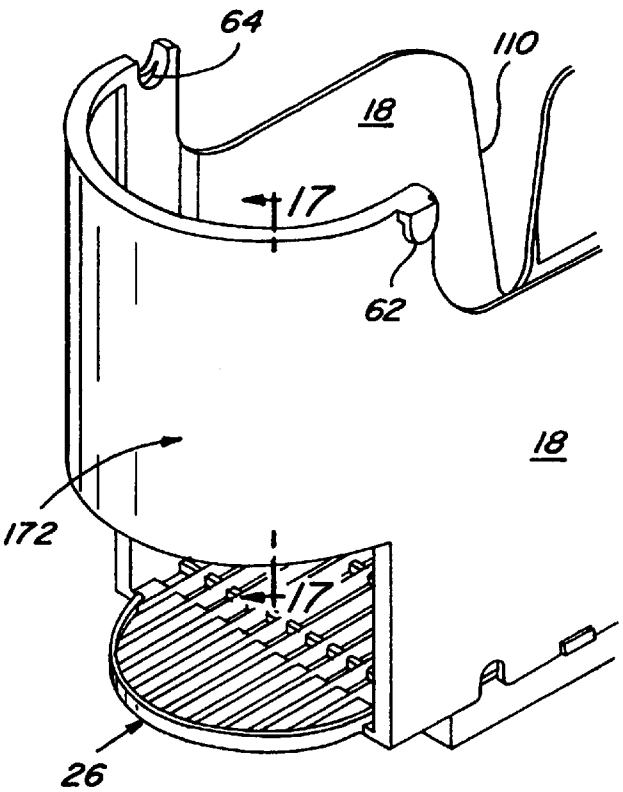
FIG. 16 is a perspective view illustrating another embodiment of the present product modules wherein the product graphic insert panel is integrally formed as part of the front portion of each respective product channel.

Although all of the various embodiments of the present product graphic insert panel such as the insert panels 32, 128, 140, 150 and 164 have been constructed so as to be removably attachable to the front portion of each product channel 30 associated with any one of the various embodiments of the present product modules, it is also recognized and anticipated that the present product insert panels can be integrally formed with the various product channel side walls such that the insert panels are no longer removably attachable to the respective front portions thereof. This embodiment is illustrated in FIG. 16 wherein product module 170 includes a product insert panel or front wall member 172 integrally formed or molded as part of each product channel. In this particular embodiment, the individual product graphics and identification associated with any particular product container can be removably attached to the product insert panel 172 through the use of removably attachable adhesive product labels or other types of removably attachable product decals or stick-on labels. Alternatively, as best shown in an alternate embodiment of front wall member 172 illustrated in FIG. 17, the insert panel or front wall member 172' may include a pair of spaced opposed flanges 174 positioned and located on the front surface of member 172' as shown in FIG. 17, the flanges 174 forming respective slots or channels 176 for receiving the top and bottom edge portions of a product graphics label (not shown) which may be slidably received within the opposed channels 176. The flanges 174 may be L-shaped in configuration as shown and such flanges may be integrally formed with the front wall panel member 172'. In addition, each flange 174 may extend substantially across the front surface of front wall member 172' between keeper member 62 and its corresponding keying slot 64, or each such flange 174 may include a plurality of spaced flanges forming a plurality of spaced channels 176 adaptable for receiving and holding portions of a suitably configured product graphics label. In this regard, the product graphics label may be constructed similar to the shape and construction of the main body portion 36 of product graphic insert panel 32 without the tab portions 38 associated therewith. Other shapes and configurations for the flanges 174, the channels 176, and the product graphic label for insertion therebetween are likewise recognized and anticipated.

Still further, the product insert panel 172 illustrated in FIG. 16 can also be made of a transparent type material and may include means for removably attaching product graphics to the rear portion thereof. In this situation, adhesively attachable product labels or other types of removably attachable product decals or stick-on labels may likewise be used, or as also alternatively shown in FIG. 17, the transparent product insert panel 172' may have the pair of opposed flanges 174 and corresponding channels 176 positioned and located on the rear surface thereof such as the flanges 174' and channel 176' illustrated in dotted outline form in FIG. 17 so that the product graphic label inserted therebetween can be viewed through the transparent front wall member 172'. In all other respects, the flanges and channels 174' and 176' function and operate substantially similar to the flanges and channels 174 and 176. Like the other embodiments of the present product modules disclosed herein, the product insert panels 172 and 172' are specifically sized, shaped and located such that they will substantially overlay the product identification and graphics associated with a particular product container positioned within that particular product channel. In all other respects, the construction and operation of the product module 170 is substantially similar to the construction and operation of all of the other product modules disclosed herein.

Figure 18:
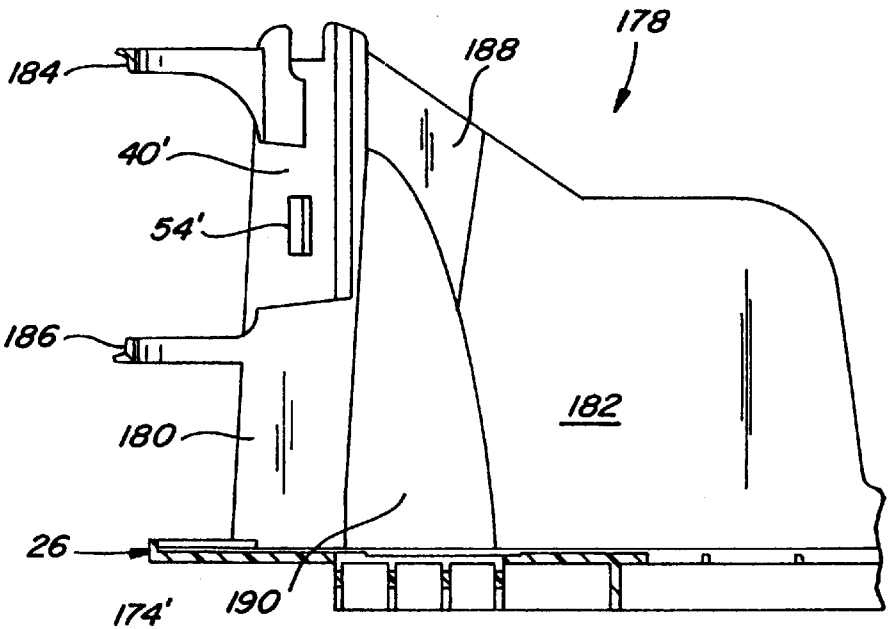
FIG. 18 is a fragmentary cross-sectional view similar to FIG. 5A showing still another embodiment of the present product modules.

FIG. 18 discloses still another embodiment 178 of the present product modules 12, 14 and 16, the module 178 being substantially similar in construction and operation to the product modules 12, 14 and 16 but differs therefrom primarily in the design and construction of the side walls associated with each product channel 30. FIG. 1 8 represents a partial cross-sectional view of product module 178 taken along a line extending longitudinally along the length of floor portion 26 such as along line 5—5 of FIG. 4 showing the construction of the interior surface of each respective post member 180. More particularly, the product module 178 includes a pair of upstanding posts 180, spaced upstanding side walls 182, and a pair of spaced arcuate front wall members 184 and 186. The respective side walls 182 of each product channel terminate aft of the front portion of each product channel and a support rib or buttress 188 is utilized to tie the respective side walls 182 to the respective upright post members 180. Although use of the support rib 188 adds additional strength and support to the front portion of the overall product module 178, it is recognized and anticipated that this support member may be eliminated and the space or opening 190 existing between members 180 and 182 as shown in FIG. 18 may further extend upwardly and completely separate members 180 and 182. This particular construction of the upright post members 180 and the side walls 182 is consistent with prior product merchandising display unit designs of the assignee of this application, namely, Paul Flum Ideas, Inc. of St. Louis, Mo., wherein the side walls of respective product channels have been secured to the upright posts or leg members formed by the inverted arch front wall design utilized in many Paul Flum Ideas, Inc. merchandising units as illustrated in U.S. Pat. Nos. 4,454,949; 4,478,337; 4,801,025; 5,351,838; 5,624,042; and others. Like the embodiments of the product module illustrated in FIGS. 5A and 5B, the upright post members 180 each include a notched or recessed area 40' defining appropriate slots such as the slots 42/42' and 44/44' (FIGS. 5A and 5B) as well as a corresponding projection 54', all of which function and operate in a similar manner as previously explained for engaging each tab portion 38 associated with the product insert panel 32. In all other respects, the construction and operation of product module 178 is substantially identical to the construction and operation of product modules 12, 14 and 16 as previously explained.

Figure 19:
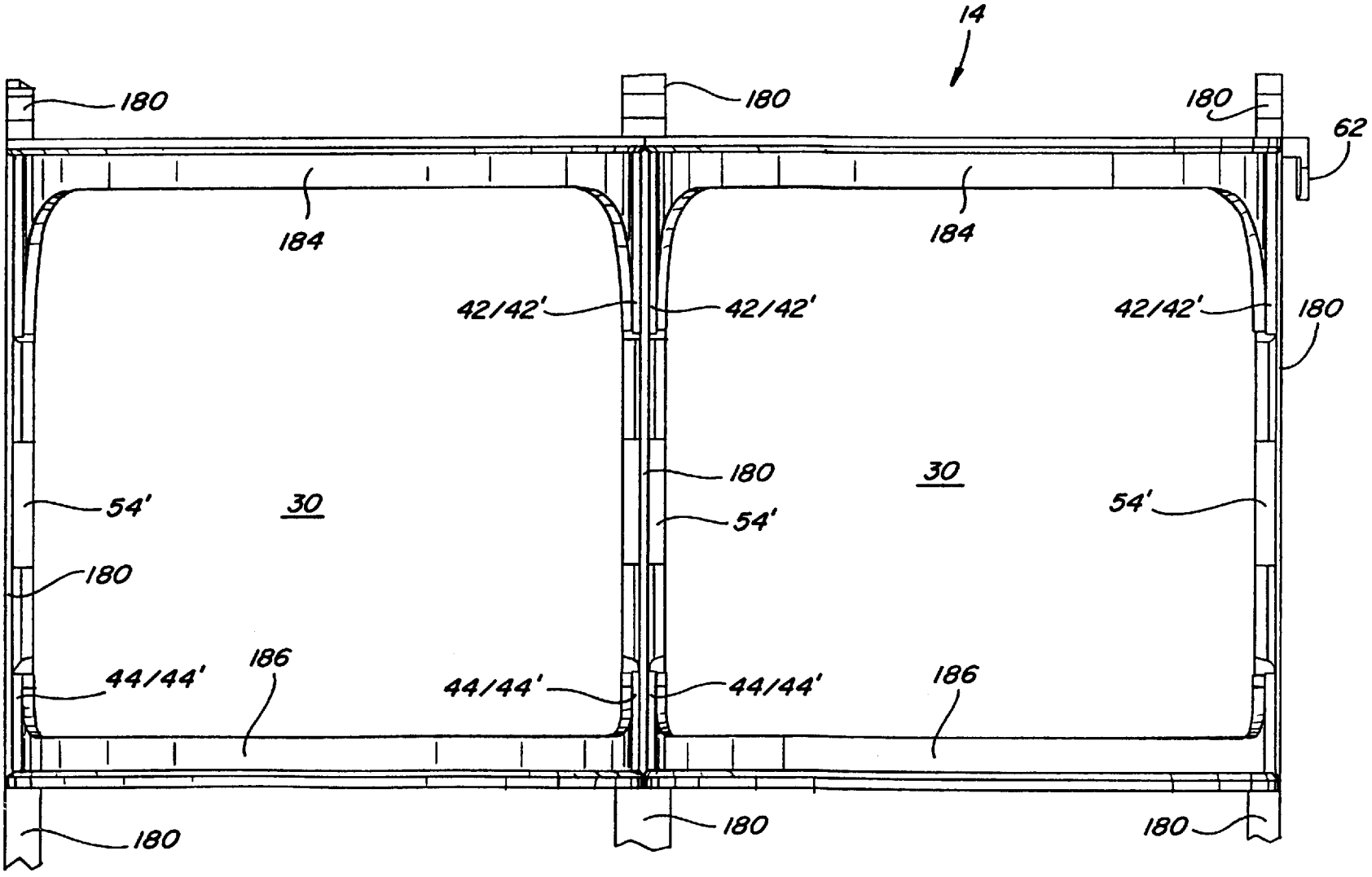
FIG. 19 is a partial front elevational view of a product module having two product channels associated therewith constructed according to the teachings of the present invention.

FIG. 19 is a partial front elevational view of a product module such as module 14 showing two product channels 30 incorporated into a single module. The particular construction associated with each product channel 30 illustrated in FIG. 19 is the product module construction illustrated in FIG. 18. In this regard, FIG. 19 illustrates the constructional arrangement of the upright post members 180, the slots 42/42' and 44/44', the projections 54', and the arcuate front wall members 184 and 186 in a modular embodiment incorporating more than one product module 30. It is recognized and anticipated that a product module can be constructed in accordance with the teachings of FIG. 19 so as to include any plurality of individual product channels 30.

Figure 20:
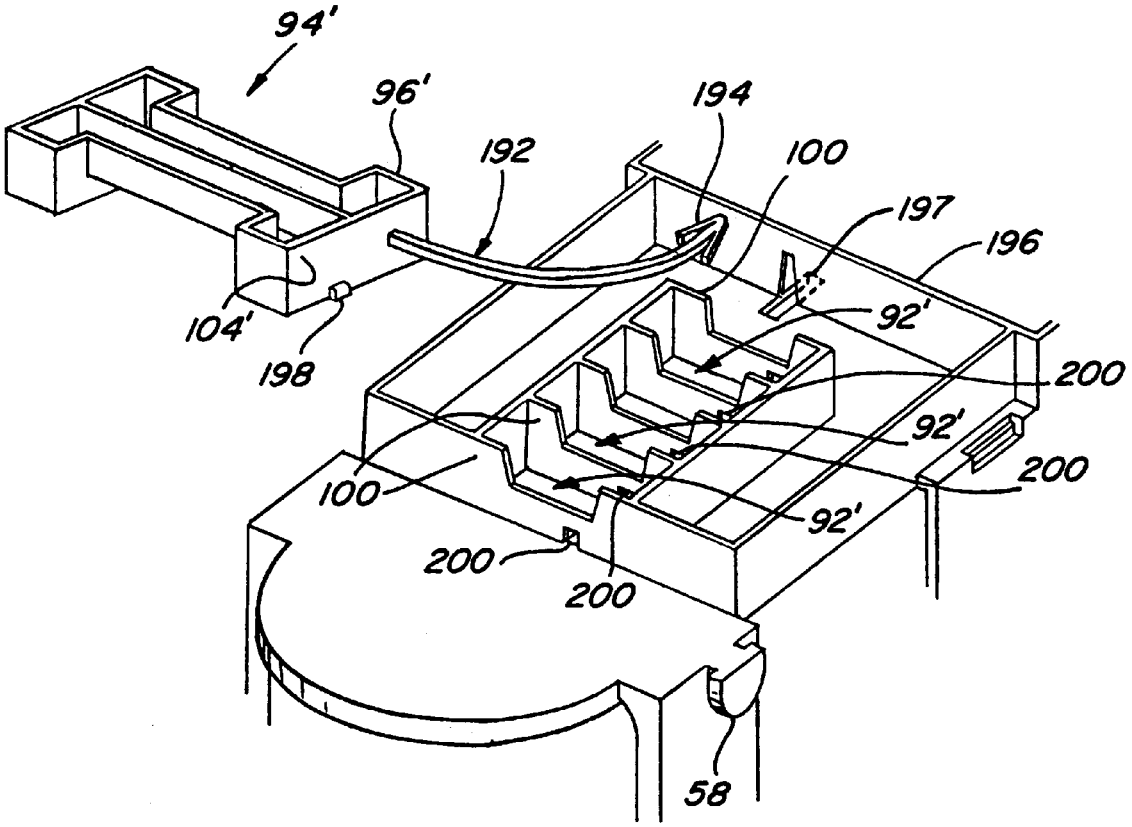
FIG. 20 is a partial perspective view of the underside front portion of one of the present product modules showing another embodiment of the adjustable mechanism associated with at least some of the product channels similar to FIG. 9 and including another embodiment of the stop member associated therewith.

FIG. 20 discloses another embodiment of the stop member 94 and the plurality of recesses, cavities and/or channels 92 illustrated in FIGS. 9 and 10 for adjusting the fore and aft position of each module relative to the transverse front rod member associated with an underlying support structure. In the embodiment illustrated in FIG. 20, the I-shaped stop member 94' includes an elongated trailing member 192 and a projection 198 associated with the outwardly facing surface 104' of one of the stop member end portions 96'. The elongated trailing member 192 includes an arrow-shaped terminal end portion 194 which is shaped and dimensioned for insertion through opening 197 located in transverse wall member 196. The opening 197 cooperatively receives trailing member end portion 194 when inserted therethrough in the direction shown in FIG. 20, but prevents passage of end portion 194 therethrough in the opposite direction. Member 192 therefore functions to secure stop member 94' to the under structure of any particular product channel 30 when such member is not engaged within any one of the plurality of cavities or channels 92 as previously explained.

In addition, projection member 198 is positioned and located so as to cooperatively engage a corresponding opening 200 associated with each transverse wall member 100 such that when the end portion 96' of stop member 94' is positioned within any one of the plurality of recesses or channels 92, the projection member 198 will engage an opening 200 thereby preventing the member 94' from inadvertently moving downwardly towards a disengaged position with respect to any one of the transverse channels 92. Use of the projection member 198 and the corresponding openings 200 in this particular embodiment replaces use of the tab portions 106 and 108 illustrated in FIG. 9. In all other respects, the construction and operation of both stop member 94' and the plurality of transverse channels 92' are substantially identical to the construction and operation of stop member 94 and the plurality of channels 92 previously explained with respect to FIG. 9. Either embodiment for adjusting the fore and aft position of the product module relative to the front rod member associated with a particular underlying support structure can be utilized for accomplishing this task.

Figure 22:
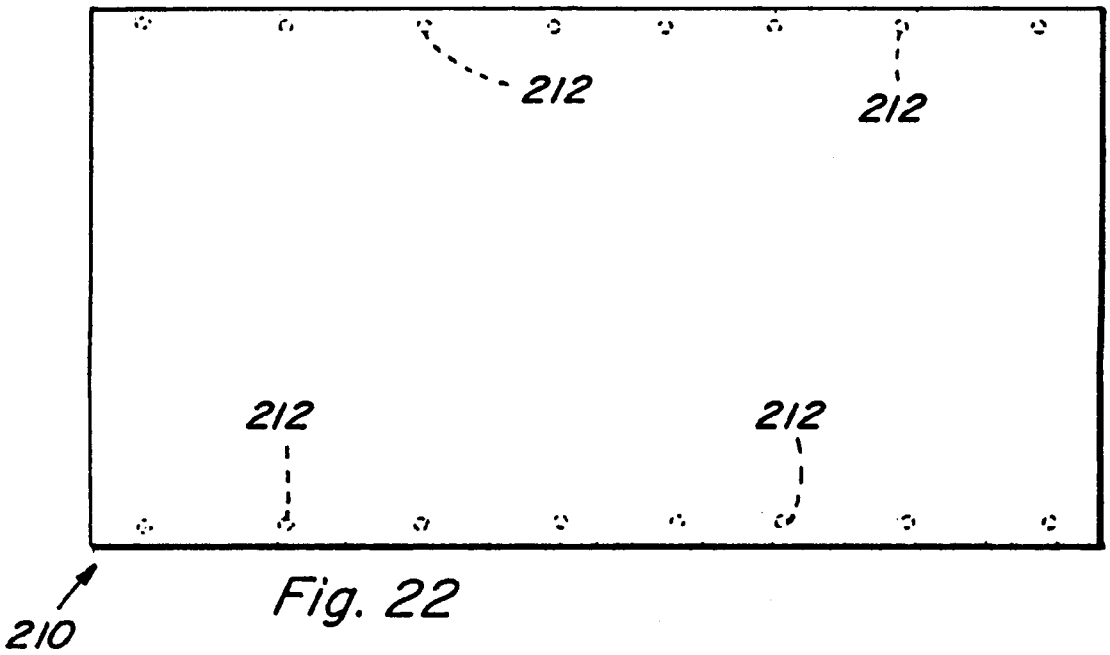
FIGS. 21 and 22 are front elevational views of yet another embodiment of the present product modules and a corresponding product graphic panel.
Figure 21:
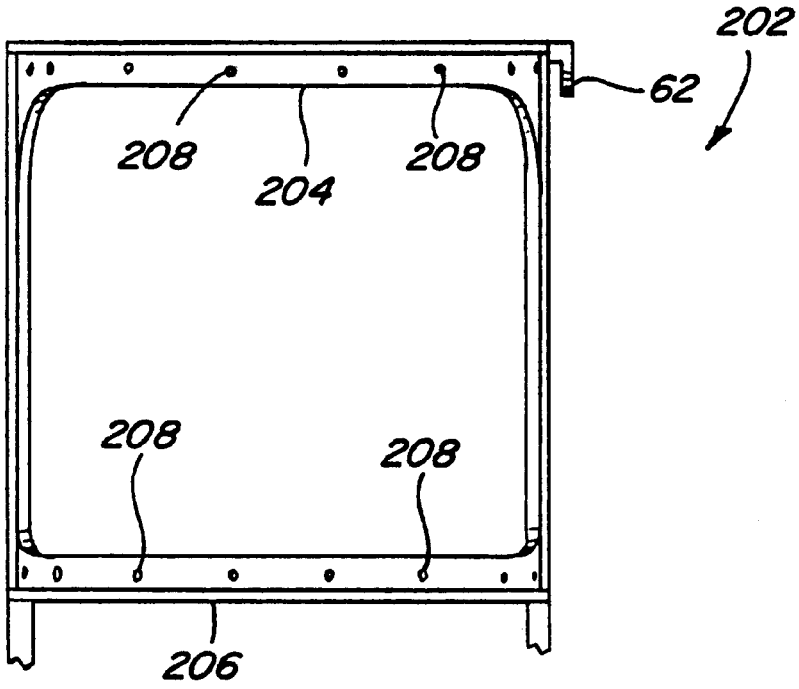

FIGS. 21 and 22 illustrate still another means for removably attaching a product graphic insert panel to the front portion of each product channel associated with any one of the present product modules wherein a pair of spaced front wall members are associated therewith. In the embodiment 202 illustrated in FIG. 21, the pair of spaced arcuate front wall members 204 and 206 each include a plurality of spaced recesses or cavities 208 positioned and located so as to cooperatively engage a corresponding number of spaced projections 212 associated with the top and bottom rear edge portions of a product insert panel such as the panel insert member 210 illustrated in FIG. 22. The projections or protrusions 212 are constructed and designed so as to be snapped into the corresponding recesses or cavities 208 associated with the front members 204 and 206, the frictional engagement therebetween being sufficient to hold the panel member 210 in proper position adjacent the front portion of the product channel. In this regard, it is recognized and anticipated that a wide variety of other snap-fastener type arrangements may be utilized to accomplish this task, and that the projections 212 may be associated with the front wall members 204 and 206 and the recessed cavities 208 may be associated with the rear portion of the panel insert member 210. This arrangement obviates the need for incorporating the various slots in the upright posts or reinforcing members 28, 28' and 180 as disclosed in the various embodiments illustrated in FIGS. 3–5, 11, 18 and 19. In all other respects, the construction and operation of the embodiment illustrated in FIGS. 21 and 22 is substantially identical to the construction and operation of product modules 12, 14 and 16.

As previously referenced above, it is also contemplated that the size and shape of the various embodiments of the present product graphic insert panel disclosed herein as well as its overall configuration can be varied so as to be compatible with the size and shape of the particular product containers being merchandised from any particular product channel. This configuration can include the arcuate configuration disclosed herein as well as a relatively flat planar configuration for product containers so configured, as well as a wide variety of still other configurations depending upon the size and shape of the product containers merchandised within any particular product channel.

It is also recognized and anticipated that the width of each product channel 30 associated with the various embodiments of the present product modules may be varied to accommodate different size product containers such as 12 oz., 16 oz., 20 oz., 1 liter, 2 liter and 3 liter soft drink containers presently utilized in the soft drink industry. It is also recognized that the width of the product channels 30 may vary within the same product module. For example, the width associated with some or all of the five product channels 30 illustrated in module 12 may be different from each other such that some product channels are capable of merchandising smaller product containers therefrom while other product channels in the same product module are capable of merchandising larger product containers therefrom. Also, importantly, all of the present product modules are reusable and can be easily attached and detached, at will, to adjacent modules to achieve any desired width and any desired number of product channels depending upon the particular merchandising application. This includes use of the present modules in a wide variety of known product merchandising display equipment including conventional refrigerated coolers.

Thus, there has been shown and described several embodiments of a novel product modular assembly for use in storing and merchandising shelved products, including products requiring refrigeration, which devices are easily adaptable for use on existing shelving equipment and fulfill all of the objects and advantages sought therefor. Many changes, modifications, variations and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A product module for supporting and merchandising products therefrom, the product module being used in combination with product containers having a defined area associated with a portion thereof for displaying product graphics therewithin, said defined area being located intermediate the top and bottom portion of said product containers, the product module comprising at least one elongated product channel having front and rear portions, said product channel being defined by a pair of laterally spaced upstanding side walls and a substantially planar product supporting floor portion extending therebetween, each of said product channel side walls having opposed front and back portions, the front portion of said pair of product channel side walls defining at least a portion of the front portion for said product channel, a removably attachable panel member including product graphics and having top, bottom and opposed side portions, and cooperatively engageable means associated with the front portion of said product channel and said panel member for removably attaching said panel member to the front portion of said product channel, said panel member being positioned and located in spaced relationship above said supporting floor portion so as to overlay the product graphics within the defined area of the lead product container when products are positioned within said product channel.

2. The product module defined in claim 1 wherein said cooperatively engageable means associated with the front portion of said product channel and said panel member includes at least one front member spaced above said floor portion and extending at least partially across said product channel, and means on said panel member for cooperatively engaging said at least one front member.

3. The product module defined in claim 2 wherein said means on said panel member for cooperatively engaging said at least one front member includes at least one fastening member positioned adjacent the top portion of said panel member, said at least one fastening member being shaped and dimensioned so as to cooperatively engage said at least one front member.

4. The product module defined in claim 1 wherein said cooperatively engageable means associated with the front portion of said product channel and said panel member includes a pair of front members spaced above the floor portion, each of said front members extending at least partially across said product channel, and means on said panel member for cooperatively engaging said pair of front members.

5. The product module defined in claim 4 wherein said means on said panel member for cooperatively engaging said pair of front members includes at least one fastening member positioned adjacent the top portion of said panel member and at least one fastening member positioned adjacent the bottom portion of said panel member, said fastening members being shaped and dimensioned so as to cooperatively engage said pair of front members.

6. A product module for supporting and merchandising products therefrom for use in combination with a product container having a predetermined area positioned between the top and bottom portions thereof for containing product graphics, the product module comprising at least one elongated product channel, each product channel having front and rear portions and each being defined by a pair of laterally spaced upstanding side walls and a substantially planar product supporting floor portion extending therebetween, a panel member including product graphics and having top, bottom and opposed side portions the front portion of each product channel side wall including at least one slot located in the plane of said side wall adaptable for receiving one of the opposed side portions of said panel member, said panel member being removably attachable to the front portion of each product channel in spaced relationship above said supporting floor portion so as to overlay the predetermined area of product graphics associated with the lead product container by insertably positioning at least a portion of the opposed side portions of said panel member into the respective slots associated with said product channel side walls.

7. The product module defined in claim 6 wherein the front portion of each product channel side wall includes a pair of slots, each pair of slots being adaptable for receiving at least a portion of one of the opposed side portions of said panel member.

8. The product module defined in claim 7 wherein the front portion of each product channel side wall includes a notched portion, said notched portion defining said pair of slots adaptable for receiving at least a portion of one of the opposed side portions of said panel member.

9. The product module defined in claim 6 including at least one front member associated with each product channel, said one front member being spaced above said floor portion and extending at least partially across said product channel, at least a portion of said panel member mating with at least a portion of said at least one front member when said panel member is removably attached to the front portion of said product channel.

10. The product module defined in claim 6 including a pair of front members associated with each product channel, each of said pair of front members being spaced above said floor portion and each extending at least partially across said product channel, at least a portion of the top portion of said panel member mating with at least a portion of one of said pair of front members and at least a portion of the bottom portion of said panel member mating with at least a portion of the other of said pair of front members when said panel member is removably attached to the front portion of said product channel.

11. The product module defined in claim 10 wherein the one of said pair of front members which mates with at least a portion of the top portion of said panel member includes a downwardly extending projection which forms an abutment surface for mating with at least a portion of the top portion of said panel member, and wherein the other of said pair of front members includes at least a partially extending raised projection which forms an abutment surface for mating with at least a portion of the bottom portion of said panel member.

12. The product module defined in claim 6 wherein each product channel side wall includes a projection, and wherein each of the opposed side portions of said panel member includes a tab portion having an opening associated therewith positioned and located so as to cooperatively receive one of said projections, each of said tab openings being cooperatively engageable with a corresponding projection when said panel member is removably attached to the front portion of said product channel.

13. The product module defined in claim 6 wherein said product module includes opposed side portions, and cooperatively engageable means associated with the respective side portions of said product module enabling said module to be coupled together with a substantially similarly constructed module.

14. The product module defined in claim 13 wherein said cooperatively engageable means associated with the respective side portions of said product module include a keeper member located adjacent the upper and forward portion of one of said opposed product module side portions and a corresponding keying slot located in opposed relationship adjacent the upper and forward portion of said other opposed product module side portion.

15. The product module defined in claim 13 including a plurality of said product modules laterally coupled together in side-by-side relationship to form a composite assembly for supporting products therein.

16. The product module defined in claim 15 wherein said plurality of product modules include modules which differ in width.

17. The product module defined in claim 15 wherein at least some of said plurality of modules include modules having a different number of product channels associated therewith.

18. The product module defined in claim 15 including additional locking means associated with each of said modules for preventing inadvertent separation when two such modules are coupled together.

19. The product module defined in claim 18 wherein said additional locking means includes at least one outwardly extending projection associated with one side portion of each of said product modules and a corresponding recess associated with the opposite side portion of each of said product modules, said recess being positioned and dimensioned to receive said projection when adjacent modules are coupled together.

20. The product module defined in claim 6 including means extending transversely across said product module between said product channel side walls at an intermediate location between the front and rear portions thereof for weakening said module whereby said module can be separated along said weakening means into separate front and rear portions.

21. The product module defined in claim 6 wherein said floor portion includes track means extending therealong within said product channel for supporting products positioned thereon.

22. The product module defined in claim 6 wherein said product channel side walls include means for allowing portions thereof to flex sidewardly to prevent binding of products located in said product channel.

23. The product module defined in claim 6 wherein each of said product channels includes a rear wall portion, said rear wall portion including means for receiving and holding a product identification card.

24. The product module defined in claim 23 wherein said means for receiving and holding a product identification card includes a channel formed in said rear wall portion.

25. The product module defined in claim 6 wherein said product module includes top, bottom, front and rear portions and is used in conjunction with an underlying support structure having at least a transversely extending front member associated therewith, means forming an abutment surface for engaging at least a portion of the transversely extending front member of said underlying support structure, and means associated with the bottom portion of said product module for selectively adjusting the position of said abutment surface relative to the front portion of said product module.

26. A product module for supporting and merchandising products therefrom comprising at least one elongated product channel, each product channel having front and rear portions and each being defined by a pair of laterally spaced upstanding side walls and a substantially planar product supporting floor portion extending therebetween; a panel member adaptable for receiving product graphics having opposed top and bottom portions and opposed side portions; first and second front members associated with each product channel; said first front member being spaced above said floor portion and extending at least partially across said product channel; said second front member being disposed intermediate said first front member and said floor portion and extending at least partially across said product channel; said first front member including at least one slot formed therethrough adaptable for receiving said panel member; said panel member being removably insertable through the slot associated with said first front member such that the bottom portion of said panel member lies adjacent said second front member.

27. The product module defined in claim 26 wherein said second front member includes a groove adaptable for receiving at least a portion of the bottom portion of said panel member, the bottom portion of said panel member being insertably receivable within said groove when said panel member is inserted through the slot associated with said first front member.

28. A product module for supporting and merchandising products therefrom for use in combination with product containers having a defined area associated with a portion thereof for containing product graphics, said defined area being located intermediate the top and bottom portions of said product containers, the product module comprising at least one elongated product channel, each product channel being defined by a pair of laterally spaced upstanding side walls and a substantially planar product supporting floor portion extending therebetween, and a front wall member including product graphics extending across said product channel, said front wall member being integrally formed with said upstanding side wall and being positioned in spaced apart relationship above said floor portion so as to overlay the defined area of product graphics associated with the lead product container when said product containers are positioned within said product channel.

29. The product module defined in claim 28 wherein said front wall member is made of a transparent type material.

30. The product module defined in claim 29 wherein said front wall member includes a pair of spaced channel members positioned and located on the rear portion thereof, said pair of channel members being adaptable for insertably receiving a member containing the product graphics, said member including product graphics substantially identical to the product graphics associated with the product containers to be merchandised from said product channel, said member overlaying the defined area of product graphics associated with the lead product container.

31. The product module defined in claim 28 wherein said front wall member includes means for removably attaching product graphics thereto.

32. The product module defined in claim 30 wherein said means for removably attaching product graphics includes a pair of spaced channel members positioned and located on the front portion of said front wall member, said pair of channel members being adaptable for insertably receiving a member containing the product graphics, said member including product graphics substantially identical to the product graphics associated with the product containers to be merchandised from said product channel, said member overlaying the defined area of product graphics associated with the lead product container.

33. A product module for supporting and merchandising products therefrom for use in combination with product containers having a defined area associated with a portion thereof for containing product graphics, the product module comprising at least one elongated product channel, each product channel having front and rear portions and each including a pair of laterally spaced upright posts a pair of laterally spaced upstanding side walls, and a substantially planar product supporting floor portion extending therebetween, said upright posts being positioned and located adjacent the front portion of said product channel, a removably attachable panel member having top, bottom and opposed side portions and including product graphics, and cooperatively engageable means associated with said panel member and said pair of upright posts for removably attaching said panel member to the front portion of said product channel, said panel member being spaced above said floor portion to overlay the defined area of product graphics associated with the lead product container when product containers are positioned within said product channel, said panel member being removably replaceable to be compatible with the specific product graphics associated with the product containers to be merchandised from said product channel.

34. The product module defined in claim 33 wherein said cooperatively engageable means includes at least one slot associated with each respective upright post, each of said slots being adaptable for receiving one of the opposed side portions of said panel member, said panel member being removably attachable to said upright posts by insertably positioning at least a portion of the opposed side portions thereof into the respective slots associated with said upright posts.

35. The product module defined in claim 34 wherein each of said upright posts includes a projection, and wherein each of the opposed side portions of said panel member includes a tab portion having an opening associated therewith, each of said tab openings being cooperatively engageable with a corresponding projection when said panel member is removably attached to said pair of upright posts.

36. The product module defined in claim 33 wherein said cooperatively engageable means includes a pair of slots associated with each respective upright post, each pair of slots being adaptable for receiving at least a portion of one of the opposed side portions of said panel member.

37. The product module defined in claim 33 wherein said cooperatively engageable means includes a notched portion associated with each respective upright post, each notched portion defining a pair of slots adaptable for receiving at least a portion of one of the opposed side portions of said panel member.

38. The product module defined in claim 33 including at least one front member spaced above said floor portion and extending at least partially across said product channel, at least a portion of said panel member mating with at least a portion of said at least one front member when said panel member is removably attached to the front portion of said product channel.

39. The product module defined in claim 33 including a pair of front members spaced above said floor portion and each extending at least partially across said product channel, at least a portion of the top portion of said panel member mating with at least a portion of one of said pair of front members and at least a portion of the bottom portion of said panel member mating with at least a portion of the other of said pair of front members when said panel member is removably attached to the front portion of said product channel.

40. The product module defined in claim 33 including at least one front member spaced above said floor portion and extending at least partially across said product channel, and means on said panel member for cooperatively engaging said at least one front member.

41. The product module defined in claim 33 including a pair of front members spaced above said floor portion, each of said front members extending at least partially across said product channel, and means on said panel member for cooperatively engaging said pair of front members.

42. The product module defined in claim 33 including a first member attaching one of said product channel side walls to one of said upright posts, and a second member attaching the other of said product channel side walls to the other of said upright posts.

43. A product display device for supporting and merchandising products therefrom for use in conjunction with an underlying support structure having at least a transversely extending front member associated therewith, said display device including top, bottom, front and rear portions, a member separate from the underlying support structure and being removably positioned relative thereto, said member having an abutment surface positionable for engagement with at least a portion of the transversely extending front member of said underlying support structure, and means associated with the bottom portion of said display device for engaging said member and selectively adjusting the position of the abutment surface associated therewith relative to the front portion of said display device, said abutment surface being engageable with at least a portion of the transversely extending front member at each selected position.

44. The product display device defined in claim 43 wherein said member includes opposed end portions, at least one of said opposed end portions forming said abutment surface.

45. The product display device defined in claim 44 wherein said means associated with the bottom portion of said display device for selectively adjusting the position of the abutment surface associated with said member includes a plurality of recesses extending across at least a portion of the bottom portion of said display device, each of said recesses being configured and dimensioned so as to cooperatively receive at least one end portion of said member.

46. The product display device defined in claim 44 wherein said means associated with the bottom portion of said display device for selectively adjusting the position of the abutment surface associated with said member includes a plurality of cavities extending across at least a portion of the bottom portion of said display device, each of said cavities being configured and dimensioned so as to cooperatively receive at least one end portion of said member.

47. The product display device defined in claim 43 wherein said member includes a substantially I-shaped member having opposed end portions, each of said opposed end portions forming said abutment surface.

48. The product display device defined in claim 47 wherein said means associated with the bottom portion of said display device for selectively adjusting the position of the abutment surface associated with said member includes a plurality of channels extending across at least a portion of the bottom portion of said display device, each of said channels being configured and dimensioned so as to cooperatively receive at least one end portion of said substantially I-shaped member.

49. The product display device defined in claim 48 wherein at least one end portion of said substantially I-shaped member includes a projection, each of said plurality of channels including an opening adaptable to cooperatively receive said projection when said one end portion is received within one of said channels.

50. A product module for supporting and merchandising products therefrom comprising at least one elongated product channel, each product channel having front and rear portions and each being defined by a pair of laterally spaced upstanding side walls and a substantially planar product supporting floor portion extending therebetween, a panel member adaptable for receiving product graphics having top, bottom and opposed side portions, the front portion of each product channel side wall including at least one slot adaptable for receiving one of the opposed side portions of said panel member, said panel member being removably attachable to the front portion of each product channel by insertably positioning at least a portion of the opposed side portions of said panel member into the respective slots associated with said product channel side walls, a pair of front members associated with each product channel, each of said pair of front members being spaced above said floor portion and each extending at least partially across said product channel, at least a portion of the top portion of said panel member mating with at least a portion of one of said pair of front members and at least a portion of the bottom portion of said panel member mating with at least a portion of the other of said pair of front members when said panel member is removably attached to the front portion of said product channel, said front member which mates with at least a portion of the top portion of said panel member further including a downwardly extending projection which forms an abutment surface for mating with at least a portion of the top portion of said panel member, and said other front member further including at least a partially extending raised projection which forms an abutment surface for mating with at least a portion of the bottom portion of said panel member.

51. A product module for supporting and merchandising products therefrom comprising at least one elongated product channel, each product channel having front and rear portions and each being defined by a pair of laterally spaced upstanding side walls and a substantially planar product supporting floor portion extending therebetween, a panel member adaptable for receiving product graphics having top, bottom and opposed side portions, the front portion of each product channel side wall including at least one slot adaptable for receiving one of the opposed side portions of said panel member, said panel member being removably attachable to the front portion of each product channel by insertably positioning at least a portion of the opposed side portions of said panel member into the respective slots associated with said product channel side walls, each product channel side wall further including a projection, and each of the opposed side portions of said panel member further including a tab portion having an opening associated therewith positioned and located so as to cooperatively receive one of said projections, each of said tab openings being cooperatively engageable with a corresponding projection when said panel member is removably attached to the front portion of said product channel.

52. A product display device for supporting and merchandising products therefrom for use in conjunction with an underlying support structure having at least a transversely extending front member associated therewith, said display device including top, bottom, front and rear portions, a substantially I-shaped member having opposed end portions, each of said opposed end portions forming said abutment surface for engaging at least a portion of the transversely extending front member of said underlying support structure, and means associated with the bottom portion of said display device for selectively adjusting the position of one of said abutment surfaces relative to the front portion of said display device.

53. A product module for supporting and merchandising products therefrom wherein the products include product graphics, the product module comprising at least one elongated product channel having front and rear portions, said product channel being defined by a pair of laterally spaced upstanding side walls and a substantially planar product supporting floor portion extending therebetween, each of said product channel side walls having opposed front and back portions, the front portion of said pair of product channel side walls defining at least a portion of the front portion for said product channel, a pair of front members associated with the front portion of said product channel and each being spaced above the floor portion, each of said front members extending at least partially across said product channel, and a removably attachable panel member adapted to receive product graphics and having lop, bottom and opposed side portions, said pair of front members each including a plurality of spaced recesses, said panel member including a plurality of spaced projections positioned adjacent the top and bottom portions thereof, said plurality of projections being cooperatively engageable with said plurality of recesses for removably attaching said panel member to the front portion of said product channel, said panel member being located above said supporting floor portion to overlay the product graphics associated with the lead product when products ale positioned within said product channel.

54. A product module for supporting and merchandising products therefrom wherein the products include product graphics, the product module comprising at least one elongated product channel having front and rear portions, said product channel being defined by a pair of laterally spaced upstanding side walls and a substantially planar product supporting floor portion extending therebetween, each of said product channel side walls having opposed front and back portions, the front portion of said pair of product channel side walls defining at least a portion of the front portion for said product channel, a removably attachable panel member adapted to receive product graphics and having top, bottom and opposed side portions, at least one recessed cavity associated with each product channel side wall and at least one corresponding fastening member associated with each opposed side portion of said panel member, said fastening members being cooperatively engageable with said corresponding cavities for removably attaching said panel member to the front portion of said product channel, said panel member being located above said supporting floor portion to overlay the product graphics associated with the lead product then products are positioned within said product channel.

55. The product module defined in claim 54 wherein said product module further includes at least one front member associated with the front portion of said product channel, said front member being spaced above said floor portion and extending at least partially across said product channel, and at least one fastening member positioned adjacent the top portion of said panel member, said at least one fastening member being shaped and dimensioned so as to cooperatively engage said at least one front member.

56. A product module for supporting and merchandising products therefrom wherein the products include product graphics, the product module comprising at least one elongated product channel having front and rear portions, said product channel being defined by a pair of laterally spaced upstanding side walls and a substantially planar product supporting floor portion extending therebetween, each of said product channel side walls having opposed front and back portions, the front portion of said pair of product channel side walls defining at least a portion of the front portion for said product channel, a removably attachable panel member adapted to receive product graphics and having top, bottom and opposed side portions, at least one slot associated with each product channel side wall and at least one corresponding fastening member associated with each opposed side portion of said panel member, said fastening members being cooperatively engageable with said corresponding slots for removably attaching said panel member to the front portion of said product channel, said panel member being located above said supporting floor portion to overlay the product graphics associated with the lead product when products are positioned within said product channel.

57. A product module for supporting and merchandising products therefrom wherein the products include product graphics, the product module comprising at least one elongated product channel having front and rear portions, said product channel being defined by a pair of laterally spaced upstanding side walls and a substantially planar product supporting floor portion extending therebetween, each of said product channel side walls having opposed front and back portions, the front portion of said pair of product channel side walls defining at least a portion of the front portion for said product channel, and a removably attachable panel member adapted to receive product graphics and having top, bottom and opposed side portions, said panel member being integrally formed with the front portion of said product channel, said panel member being located above said supporting floor portion to overlay the product graphics associated with the lead product when products are positioned within said product channel.

* * * * *

UNITED STATES PATENT AND TRADEMARK OFFICE
CERTIFICATE OF CORRECTION

PATENT NO. : 6,142,316
DATED : November 7, 2000
INVENTOR(S) : Harbour et al

It is certified that errors appear in the above-identified patent and that said Letters Patent are hereby corrected as shown below:

In the SUMMARY OF THE INVENTION:
Col. 6, line 10, delete "gravity-free" and insert – gravity-feed --.

In the claims:
Claim 53, Col. 31, line 63, delete "lop" and insert –top --.
Claim 54, Col. 32, line 29, delete "then" and insert – when --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*